US009194574B2

(12) United States Patent
Watanabe et al.

(10) Patent No.: US 9,194,574 B2
(45) Date of Patent: Nov. 24, 2015

(54) ILLUMINATION LIGHT SOURCE

(71) Applicant: PANASONIC CORPORATION, Osaka (JP)

(72) Inventors: Kenta Watanabe, Osaka (JP); Atsushi Motoya, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1 day.

(21) Appl. No.: 14/444,302

(22) Filed: Jul. 28, 2014

(65) Prior Publication Data

US 2015/0036361 A1 Feb. 5, 2015

(30) Foreign Application Priority Data

Jul. 30, 2013 (JP) ..... 2013-157479

(51) Int. Cl.

| | |
|---|---|
| ***F21V 29/00*** | (2015.01) |
| ***F21V 29/507*** | (2015.01) |
| ***F21K 99/00*** | (2010.01) |
| ***F21V 29/76*** | (2015.01) |

(52) U.S. Cl.

CPC ..... *F21V 29/507* (2015.01); *F21K 9/137* (2013.01); *F21V 29/763* (2015.01)

(58) Field of Classification Search

CPC ..... F21V 29/10; F21V 29/20; F21V 29/50; F21V 29/763; F21V 29/767; F21V 29/77; F21V 29/78

USPC ..... 362/373, 294, 249.02

See application file for complete search history.

(56) References Cited

U.S. PATENT DOCUMENTS

| | | | | |
|---|---|---|---|---|
| 8,534,875 | B1 * | 9/2013 | Zhang | F21V 9/00 313/46 |
| 8,628,218 | B2 * | 1/2014 | Yu | F21S 8/04 362/294 |
| 8,816,575 | B2 * | 8/2014 | Kimiya | F21V 29/004 313/11 |
| 8,894,254 | B2 * | 11/2014 | Matsuda | F21S 8/026 362/249.03 |
| 2013/0016511 | A1 * | 1/2013 | Mansfield | F21K 9/00 362/244 |
| 2014/0204594 | A1 | 7/2014 | Kanazawa et al. | |

FOREIGN PATENT DOCUMENTS

| | | |
|---|---|---|
| JP | 2011-258372 | 12/2011 |

* cited by examiner

*Primary Examiner* — Ali Alavi
(74) *Attorney, Agent, or Firm* — Greenblum & Bernstein P.L.C.

(57) ABSTRACT

An illumination light source includes a light emitting module having a light emitting part, a circuit unit, a base, a tube-like first housing member to accommodate the circuit unit, and a second housing member having a plurality of radiation fins. The light emitting module is disposed on one opening-side of the first housing member, while the base is disposed on the other opening-side. The second housing member includes a rotary ring body with a rotation axis agreeing with the center axis of the first housing member, and the plurality of the plate-lake radiation fins. The plurality of the radiation fins is parallel to one virtual plane containing the rotation axis, and disposed at intervals between each other in the direction orthogonal to the virtual plane. The inner wall of the rotary ring body surrounds the outer walls of the first and second housing members to combine the members.

12 Claims, 23 Drawing Sheets

ZEnlarged Z-portion

Enlarged Y-portion

ILLUMINATION LIGHT SOURCE

FIELD OF THE INVENTION

The present disclosure relates to illumination light sources which employ LEDs (Light Emitting Diodes) and the like as their light sources.

BACKGROUND OF THE INVENTION

In recent years, there have been introduced illumination light sources which use LEDs as light sources, in view of energy saving.

FIG. 23 is a partial cross-sectional view of an illumination light source according to a related art. Illumination light source 1100 includes light emitting module 1110 having LEDs, circuit unit 1120 to make light emitting module 1110 light up, and case 1130 with a substantially-cylindrical shape to accommodate circuit unit 1120. On the outer wall of case 1130, a plurality of radiation fins 1140 with a flat-plate shape is radially disposed.

Generally, illumination light source 1100 is mounted on a ceiling and the like, in the vertically downward direction. In this mode of usage, when illumination light source 1100 lights up, heat is generated by such as light emitting module 1110 and circuit unit 1120 to warm surrounding air of illumination light source 1100. This generates air streams around illumination light source 1100, which flow in the vertically upward direction. The air streams flowing vertically upward can smoothly pass through gaps between radiation fins 1140, which allows every radiation fin 1140 to perform heat exchange with outside air.

SUMMARY OF THE INVENTION

An illumination light source according to various embodiments includes a light emitting module having light emitting parts, a circuit unit, a base, a first housing member with a tube-like shape to accommodate the circuit unit, and a second housing member having a plurality of radiation fins.

The light emitting module is electrically coupled with the circuit unit. The circuit unit is electrically coupled with the base. The light emitting module is disposed on one opening side of the tube-like first housing member, while the base is disposed on the other opening side.

The second housing member includes a plurality of plate-like radiation fins, and a rotary ring body having a rotation axis agreeing with the center axis of the first housing member. The plurality of the radiation fins are in parallel with a virtual plane containing the rotation axis, and is disposed at intervals between each other in the direction orthogonal to the virtual plane. The inner wall of the rotary ring body surrounds the outer wall of the tube-like shape, so that the first housing member is combined with the second housing member. The second housing member is rotatably attached to the first housing member, about the center axis.

With the configuration described above, even when the illumination light source is mounted at an inclination relative to the vertical direction, it is possible to efficiently radiate the heat generated from the light emitting module and the like.

DETAILED DESCRIPTION OF PREFERRED EMBODIMENTS

Figure 23:
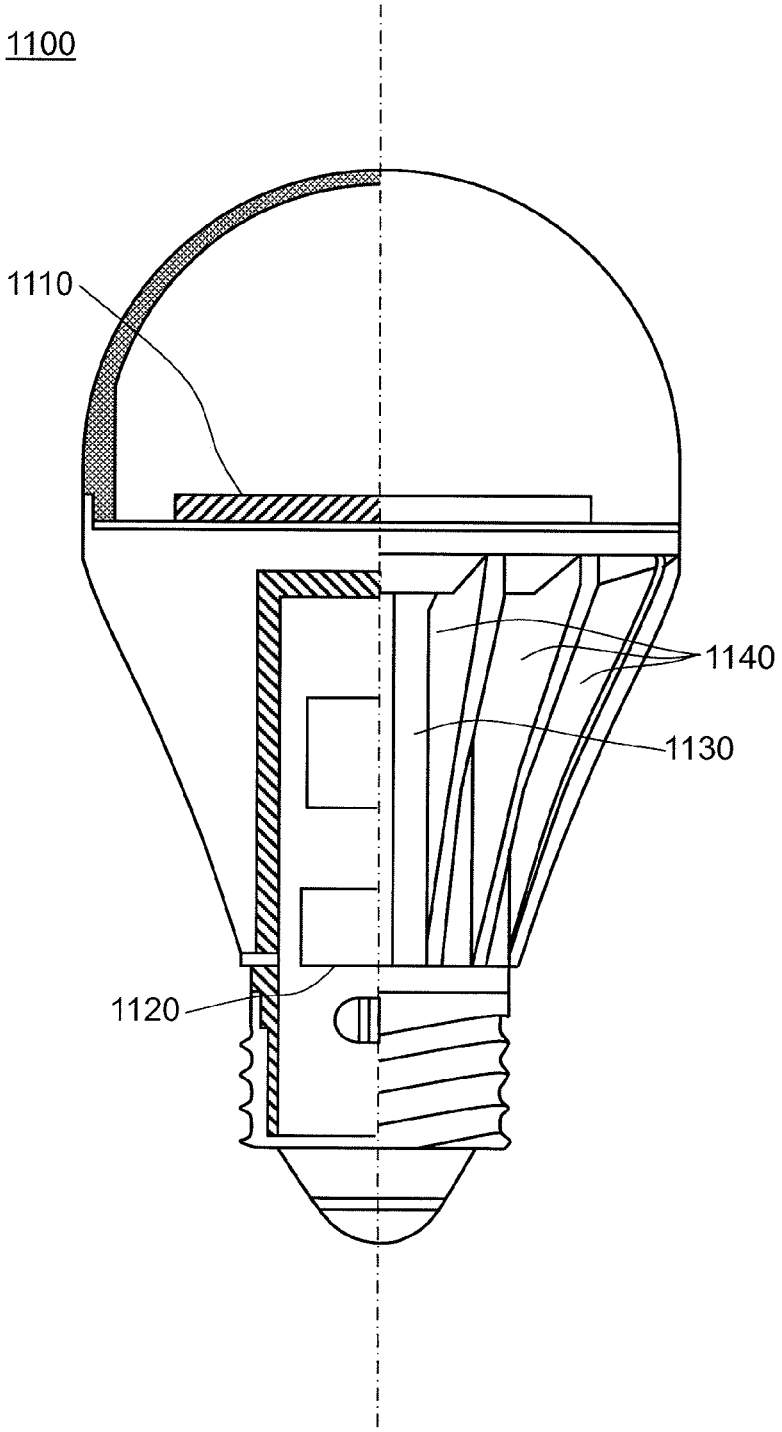
FIG. 23 is a partial cross-sectional view of an illumination light source according to a related art.

Prior to descriptions of embodiments, problems of illumination light sources according to a related art will be described. In illumination light source 1100 shown in FIG. 23, heat exchange with outside air is sometimes inefficiently performed depending on the mounting posture of the light source to a lighting fixture and the like. Specifically, when illumination light source 1100 is mounted in a direction either slanting relative to or orthogonal to the vertical direction, air streams flowing vertically upward are less prone to flow due to blockage by plate surfaces of each of radiation fins 1140. For this reason, the warmed air tends to stagnate inside gaps between radiation fins 1140, resulting in a reduced efficiency of the heat radiation of each of radiation fins 1140.

Illumination light sources according to the embodiments of the present disclosure will be described, with reference to the accompanying drawings. It is noted, however, that all of the embodiments to be described hereinafter are intended only to illustrate preferred specific examples. Consequently, values, shapes, materials, elements, arrangements and locations of the elements, coupling modes of the elements, and the like to be described hereinafter are nothing more than specific examples, and are in no way intended to limit the present disclosure.

In addition, each of the accompanying figures is schematic, and is not necessarily an accurate illustration. Throughout the figures, substantially identical structures are designated by the same reference numerals and symbols, and duplicate explanations thereof will be omitted or simplified.

[Appearance Configuration]

Figure 1:
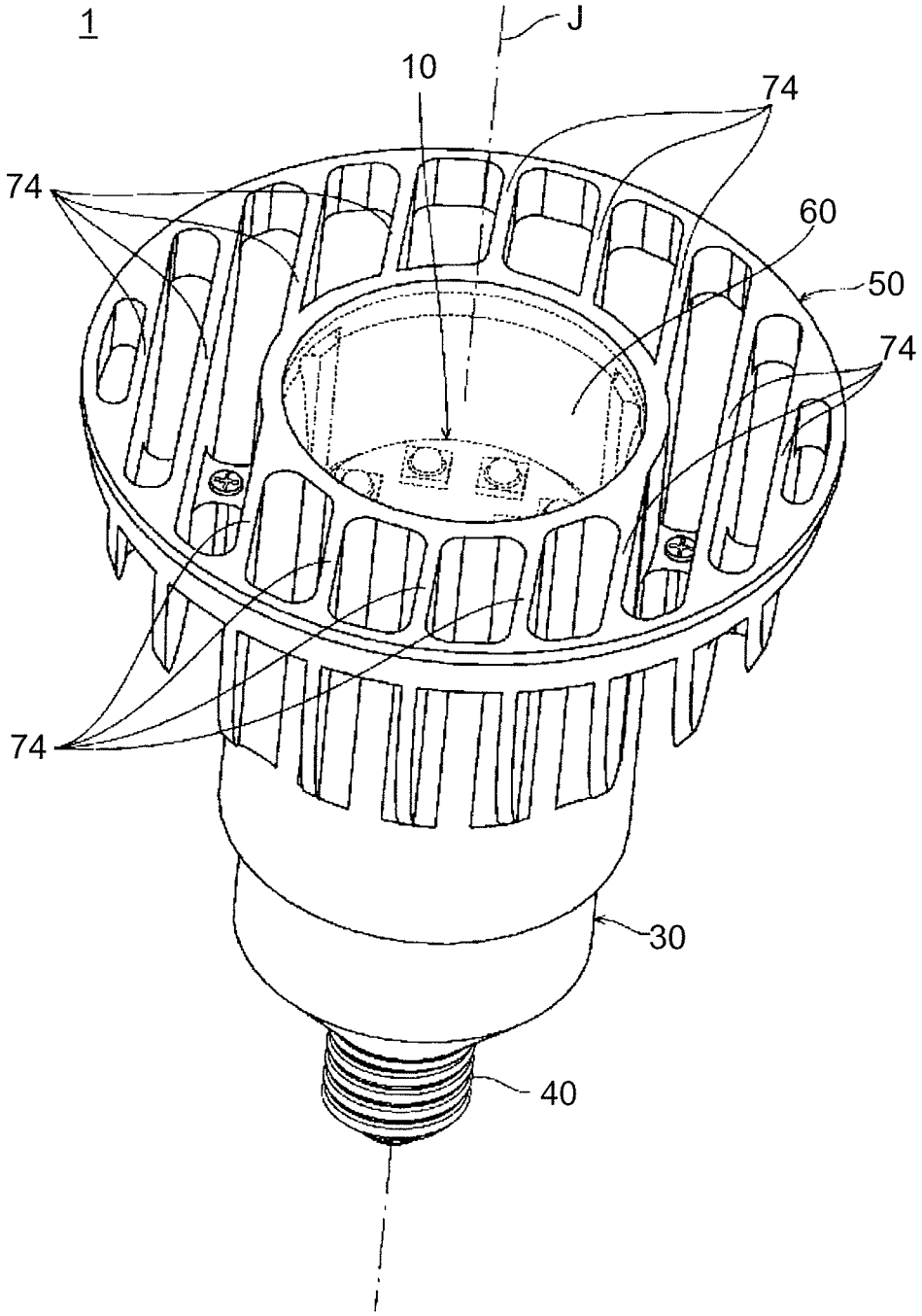
FIG. 1 is a perspective view of an appearance configuration of an illumination light source according to the embodiment.

FIG. 1 is a perspective view of an appearance configuration of illumination light source 1 according to the embodiment. The exterior of illumination light source 1 is configured with case 30, base 40, radiation member 50, and cover 60. Case 30 serves as a first housing member. Radiation member 50 serves as a second housing member. Case 30 has a substantially-cylindrical shape, and its center axis J is agreeing with the rotation axis of illumination light source 1. Radiation member 50 includes a plurality of flat-plate radiation fins 74. In a hollow part which is disposed in the center portion of radiation member 50, light emitting module 10 is accommodated which includes light emitting parts 12. Cover 60 is a disk-like member which covers an opening disposed in the center portion of radiation member 50.

[Basic Configuration of Each Member]

Figure 2:
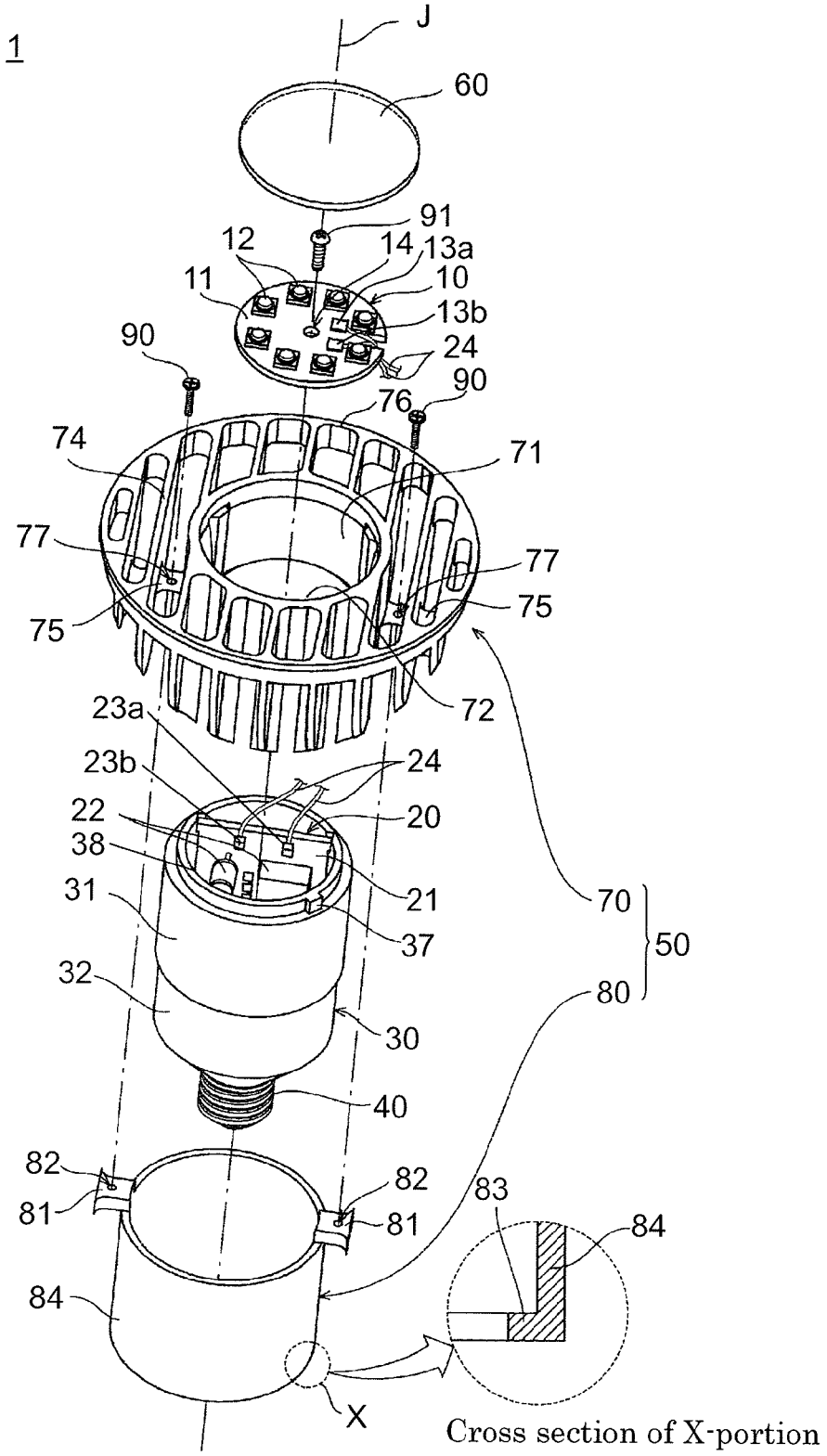
FIG. 2 is an exploded perspective view of the illumination light source shown in FIG. 1.

FIG. 2 is an exploded perspective view of each of members which configure illumination light source 1.

(Light Emitting Module)

Light emitting module 10 includes mounting substrate 11, a plurality of light emitting parts 12 disposed on mounting substrate 11, and first connection terminal 13*a* and second connection terminal 13*b* (hereinafter, referred to as "connection terminals 13*a* and 13*b*"). Mounting substrate 11 is a metal-base substrate which is configured with a resin plate and a metal plate, for example. On the upper surface of the substrate, a wiring pattern (not shown) is disposed. Each of light emitting parts 12 is configured with a semiconductor light-emitting element such as an LED. Connection terminals 13*a* and 13*b* are electrically coupled with each of light emitting parts 12 via the wiring pattern.

(Circuit Unit)

Circuit unit 20 includes circuit board 21 and various kinds of electronic components 22 mounted on circuit unit 20. On circuit board 21, there are disposed first connection terminal 23*a* and second connection terminal 23*b* (hereinafter, referred to as "connection terminals 23*a* and 23*b*"). Connection terminals 23*a* and 23*b* are electrically coupled with connection terminals 13*a* and 13*b* of light emitting module 10, respectively, via lead wires 24. Moreover, circuit unit 20 is electrically coupled with base 40 via lead wires (not shown).

(Case)

Case 30 serving as the first housing member is substantially cylindrical, and includes large-diameter part 31 and small-diameter part 32. Case 30 is rotationally symmetric about center axis J. In the inside of case 30, circuit unit 20 is accommodated. Case 30 is formed with an electrical insulating material such as a resin or a ceramic, for example.

(Base)

Base 40 is a so-called Edison-type screw base, and is disposed at an opening end part on one end side of case 30.

(Radiation Member)

Radiation member 50 serving as the second housing member is an integrally-molded article which is configured with a material excellent in heat conductivity, such as aluminum, copper, or iron. Radiation member 50 is operative to radiate heat to the outside, with the heat being generated from light emitting module 10 and circuit unit 20. Radiation member 50 is configured with first radiation member 70 and second radiation member 80, with the first and second members being combined with each other with screws 90. Radiation member 50 has a rotation mechanism, the rotation axis of which is agreeing with center axis J of the first housing member.

First radiation member 70 includes tube-like part 71, bottom plate 72, a plurality of radiation fins 74, connection parts 75, and rim part 76.

Tube-like part 71 is substantially cylindrical, and plays a role of a peripheral wall of the hollow part which accommodates light emitting module 10 therein.

Bottom plate 72 has a substantially disk-like shape, and plays a role of a bottom wall of the hollow part which accommodates light emitting module 10 therein. In the center portion of bottom plate 72, a screw hole is disposed (not shown in FIG. 2). Screw 91 is inserted into hole 14 of light emitting module 10, and then screw 91 is screwed into the screw hole to fix light emitting module 10 to bottom plate 72.

Figure 3:
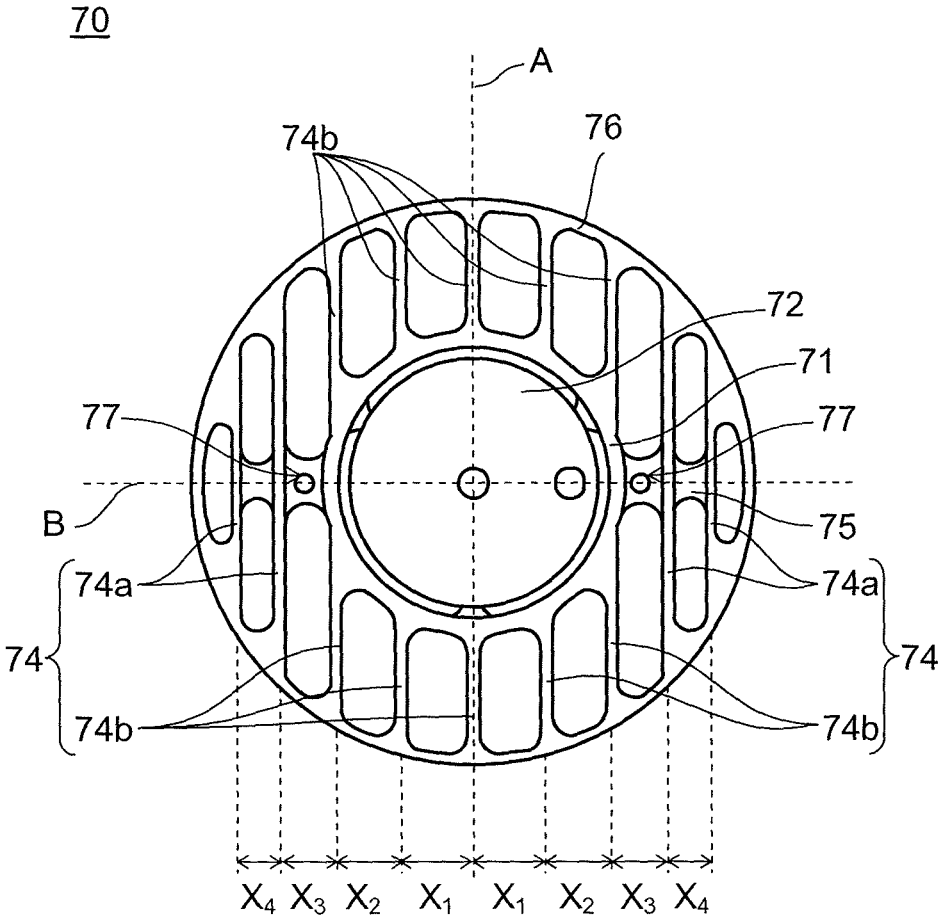
FIG. 3 is an elevational view of a radiation member shown in FIG. 1.

Radiation fins 74 each have a flat-plate shape, and are in parallel with one another. Specifically, as shown in the elevational view of FIG. 3, each of radiation fins 74 is disposed in such a manner that: That is, the fin is in parallel with a virtual plane (hereinafter, referred to as plane A) which contains the rotation axis of tube-like part 71, and is away from the next fin in the orthogonal direction (hereinafter, referred to as direction B) relative to plane A. In the figure, X1 to X4 represent gaps between adjacent radiation fins 74. The gaps between adjacent radiation fins 74 are preferably set to become smaller, with increasing distance from the center to the adjacent fins in direction B (X1>X2>X3>X4).

Radiation fins 74 are preferably configured with first radiation fins 74*a* and second radiation fins 74*b*. First radiation fins 74*a* are disposed to be outward away from the outer wall of tube-like part 71, in direction B. Second radiation fins 74*b* are disposed on the outer wall of tube-like part 71.

Referring back to FIG. 2, connection parts 75 are disposed between tube-like part 71 and first radiation fins 74*a*. In each of connection parts 75, hole 77 is disposed to allow screw 90 to pass therethrough.

Rim part 76 connects outer edges of radiation fins 74. Rim part 76 plays a role in enhancing mechanical strength of the plurality of radiation fins 74. In addition, rim part 76 serves as a hand grip for a user, either in attaching illumination light source 1 to a lighting fixture (not shown) or in rotating radiation member 50.

Second radiation member 80 includes rotary ring body 84, projections 81, and reduced-inner-diameter ring part 83 (for reduced-inner-diameter ring part 83, see the inserted cross-sectional view of X-portion in the Figure). Rotary ring body 84 is substantially cylindrical. On one end part of rotary ring body 84, a pair of projections 81 is formed. In each of projections 81, screw hole 82 is formed. On the other end part of rotary ring body 84, reduced-inner-diameter ring part 83 is formed which extends toward the center axis.

Here, the inner diameter of rotary ring body 84 is larger than the outer diameter of large-diameter part 31 of case 30, while the inner diameter of reduced-inner-diameter ring part 83 is larger than the outer diameter of small-diameter part 32 of case 30. Rotary ring body 84 is assembled such that its inner wall surrounds the outer wall of large-diameter part 31 of case 30. In assembling of illumination light source 1, the base 40 side of case 30 is first inserted from one end of second radiation member 80, and then large-diameter part 31 of case 30 is fitted into rotary ring body 84 of second radiation member 80. Then, first radiation member 70 is arranged to overlap with second radiation member 80, and projections 81 of second radiation member 80 are caused to abut on connection parts 75 of first radiation member 70. After that, screws 90 are passed through holes 77 of connection parts 75, and then screws 90 are screwed into screw holes 82 of projections 81. In this way, first radiation member 70 and second radiation member 80 are combined into a one-piece body, i.e. radiation member 50.

(Cover)

Cover 60 is a disk-like member for covering the opening of tube-like part 71, which is operative to diffuse the light emitted from light emitting module 10, thereby adjusting light distribution characteristics of illumination light source 1. Cover 60 is formed with a translucent material including, for example, a glass and a resin material such as an acryl or a polycarbonate resin.

[Rotation Mechanism]

Figure 4:
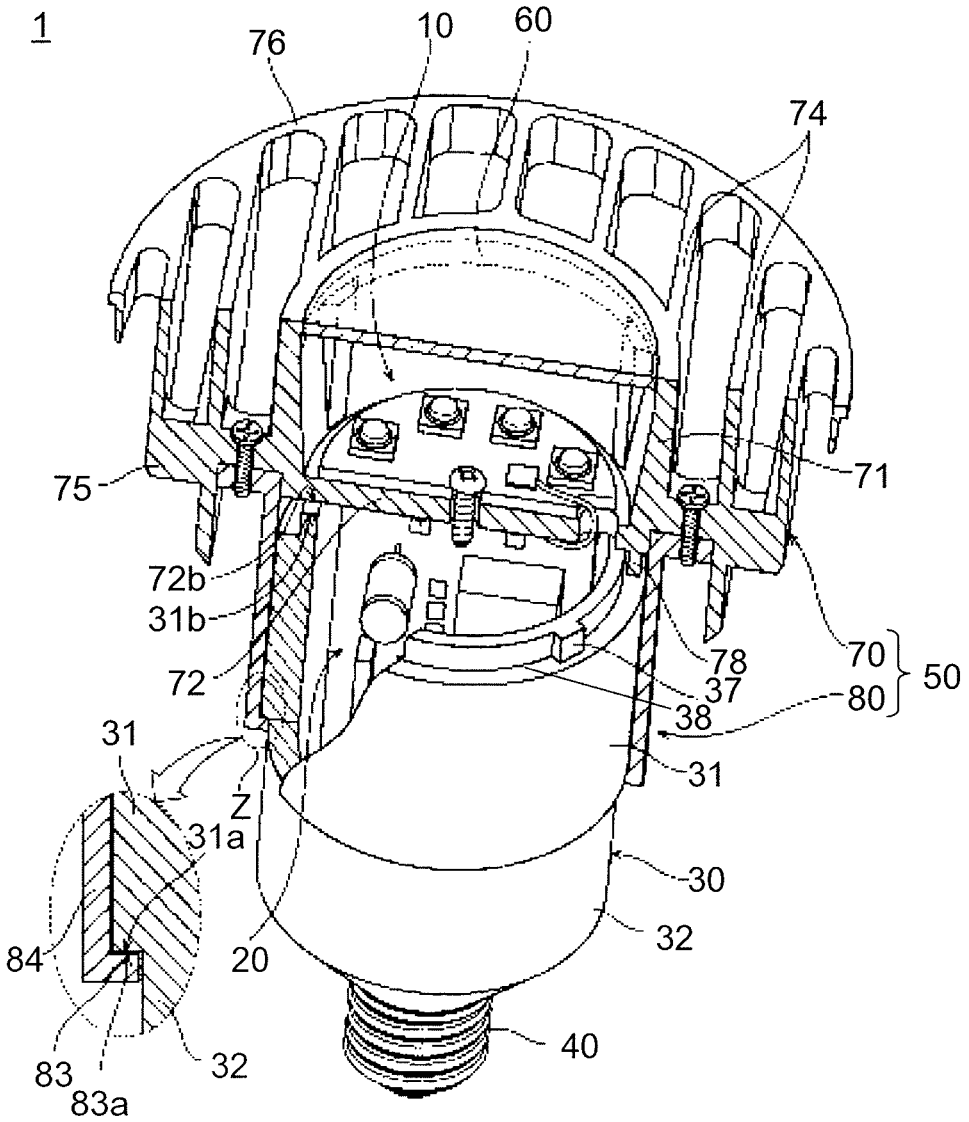
FIG. 4 is a partial cross-sectional view of the illumination light source shown in FIG. 1.

The rotation mechanism of illumination light source 1 will be described. FIG. 4 is a partial cross-sectional view of illumination light source 1. As shown in the inserted enlarged view of Z-portion in the Figure, one surface 83*a* of reduced-inner-diameter ring part 83 of radiation member 50 is positioned to face end surface 31*a* of large-diameter part 31 of case 30, which thereby prevents case 30 from falling off. In addition, one surface 72*b* of bottom plate 72 of radiation member 50 is positioned to face end surface 31*b* of large-diameter part 31. In this way, large-diameter part 31 is sandwiched between reduced-inner-diameter ring part 83 and bottom plate 72, which thereby prevents radiation member 50 from moving relative to case 30 in both directions of center axis J.

Moreover, both rotary ring body 84 of second radiation member 80 and large-diameter part 31 of case 30 are substantially cylindrical. The rotation axis of rotary ring body 84 is agreeing with center axis J of large-diameter part 31. Then, both the inner diameter of rotary ring body 84 and the outer diameter of large-diameter part 31 are set to yield a slight clearance between the inner peripheral surface of rotary ring body 84 and the outer wall of large-diameter part 31. This allows radiation member 50 to rotate about the center axis of large-diameter part 31. With this configuration, radiation member 50 is rotatably held relative to case 30. That is, the rotation mechanism is adopted between radiation member 50 and case 30.

It is noted that, on bottom plate 72 of radiation member 50, restriction part 78 is formed to restrict the rotation, as shown in FIG. 4. The outer side part of one end of large-diameter part 31 of case 30 includes stepped part 38 which has an outer diameter slightly smaller than that of large-diameter part 31. On stepped part 38, stopper 37 is formed to restrict the allowable range of rotation of radiation member 50. Illumination light source 1 is provided with one restriction part 78 and one stepped part 38. With this configuration, the number of rotation of radiation member 50 relative to case 30 is restricted to be smaller than one.

[Modes of Use of Illumination Light Source]

Figure 5A:
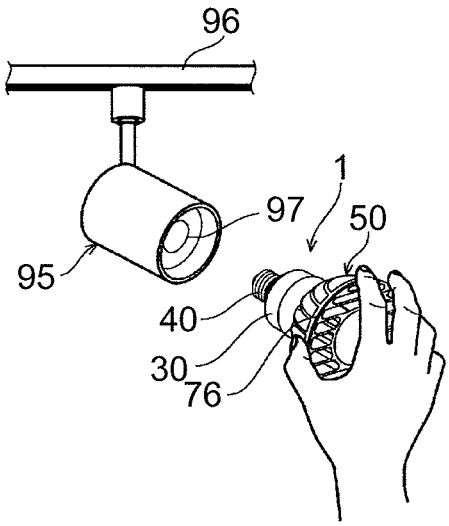
FIG. 5A is a view of an exemplified mode of use of the illumination light source shown in FIG. 1, which illustrates the state before the illumination light source is attached to a lighting fixture.

FIGS. 5A to 5D are views of an exemplified mode of use of illumination light source 1. Throughout these figures, the downward direction on the paper sheets of the views refers to the vertically downward direction. FIG. 5A shows the state before illumination light source 1 is attached to lighting fixture 95. In this example, lighting fixture 95 is mounted to wiring duct 96 installed on a ceiling or the like. Moreover, the orientation of lighting fixture 95 can be freely changed.

Figure 5B:
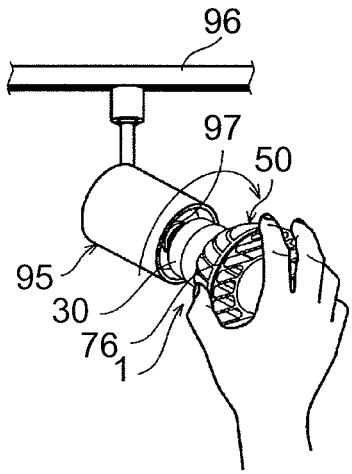
FIG. 5B is a view of the exemplified mode of use of the illumination light source shown in FIG. 1, which illustrates the state where a base of the illumination light source is being screwed into a socket.

FIG. 5B shows the state where base 40 of illumination light source 1 is being screwed into socket 97. The user grasps rim part 76 of radiation member 50 with user's hand, and applies a clockwise force to radiation member 50. This causes radiation member 50 to rotate relative to case 30. Then, restriction 78 of radiation member 50 comes in contact with stopper 37 of case 30, which thereby conveys the clockwise force applied to radiation member 50 to case 30, resulting in the rotation of case 30 together with radiation member 50 as an integral whole. With this configuration, base 40 is screwed into socket 97. It is noted that, alternatively, case 30 may be grasped to directly apply the clockwise force to case 30, which thereby screws base 40 into socket 97.

Figure 5C:
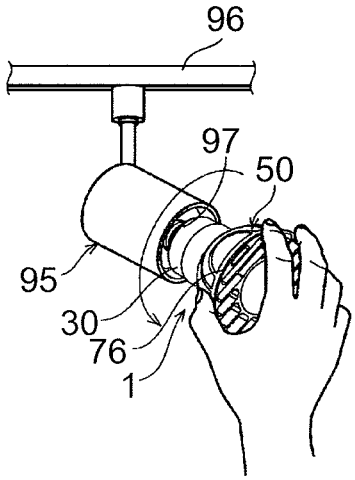
FIG. 5C is a view of the exemplified mode of use of the illumination light source shown in FIG. 1, which illustrates the state where the orientation of a plurality of radiation fins is being adjusted.

FIG. 5C shows the state where the orientation of the plurality of radiation fins 74 is being adjusted. After base 40 has been screwed into socket 97, the user then applies a counterclockwise force to radiation member 50 so as to cause radiation member 50 to rotate relative to case 30.

Figure 5D:
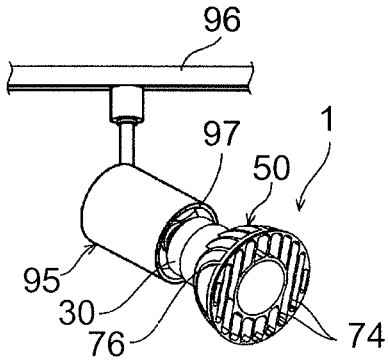
FIG. 5D is a view of the exemplified mode of use of the illumination light source shown in FIG. 1, which illustrates the state after the orientation of the plurality of the radiation fins has been adjusted.

FIG. 5D shows the state after the orientation of the plurality of radiation fins 74 has been adjusted. In the state, the adjustment is made such that the plate surfaces of all radiation fins 74 are oriented along the vertical direction. In this way, even after illumination light source 1 has been mounted with center axis J of case 830 being at an inclination relative to the vertical direction, the plate surfaces of radiation fins 74 can be oriented along the vertical direction, by rotating radiation member 50 about center axis J of case 830.

Here, the rotation torque required for the counterclockwise rotation of radiation member 50 relative to case 30, is adjusted to be smaller than the rotation torque required for the counterclockwise rotation of illumination light source 1 to remove the light source from socket 97 of lighting fixture 95 where the light source is mounted to the socket. For this reason, as shown in FIG. 5C, even when radiation member 50 is applied with the counterclockwise force to cause radiation member 50 to rotate relative to case 30, base 40 does not rotate relative to socket 97, retaining the state of being mounted to socket 97.

For example, in the case where the diameter of base 40 is 26 mm (E26 base) or 27 mm (E27 base), the rotation torque required for removing base 40 from socket 97 is larger than 5.0 Nm. Therefore, in this case, the rotation torque required for rotating radiation member 50 relative to case 30 may be set not smaller than 0.5 Nm and not larger than 5.0 Nm. Moreover, in the case where the diameter of base 40 is 12 mm (E12 base), 14 mm (E14 base), or 17 mm (E17 base), the rotation torque required for removing base 40 from socket 97 is larger than 1.5 Nm. Therefore, in this case, the rotation torque required for rotating radiation member 50 relative to case 30 may be set not smaller than 0.5 Nm and not larger than 1.5 Nm.

The rotation torque required for rotating radiation member 50 relative to case 30 can be set by adjusting, for example, the coefficient of friction between the outer wall of large-diameter part 31 of case 30 and the inner peripheral surface of rotary ring body 84 of radiation member 50. The coefficient of friction between the outer wall of large-diameter part 31 and the inner peripheral surface of rotary ring body 84, can be changed by adjusting the factors including, for example: The degree of adhesion between the outer wall of large-diameter part 31 and the inner peripheral surface of rotary ring body 84; the area where the outer wall of large-diameter part 31 faces the inner peripheral surface of rotary ring body 84; the materials of large-diameter part 31 and rotary ring body 84; and the material of lubricant applied between the outer wall of large-diameter part 31 and the inner peripheral surface of rotary ring body 84.

[Advantages]

Hereinafter, advantages of illumination light source 1 will be described in comparison with Comparative Examples. Here, the description is made for the case where illumination light source 1 is mounted, with center axis J being set in the direction perpendicular to the vertical direction.

Figure 6A:
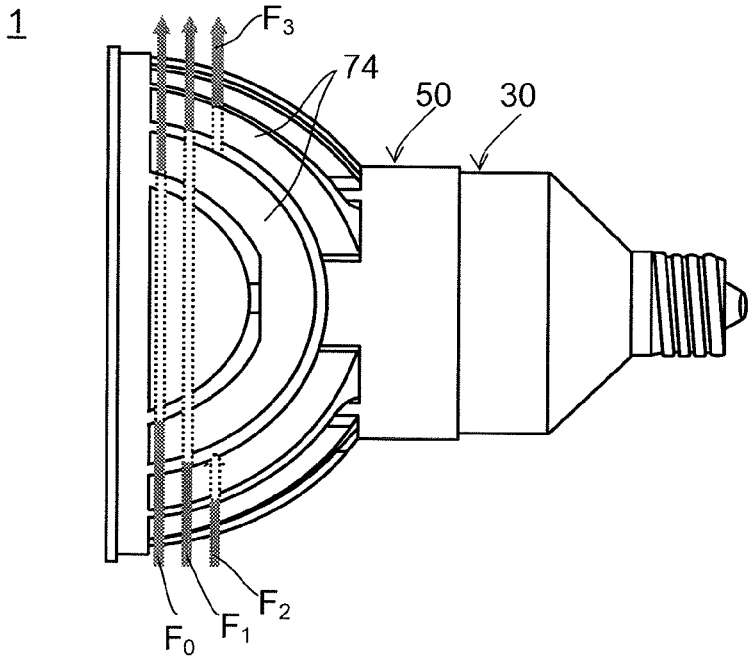
FIG. 6A is a side-elevational view of the illumination light source shown in FIG. 1, which illustrates air streams during lighting-up of the light source.
Figure 6B:
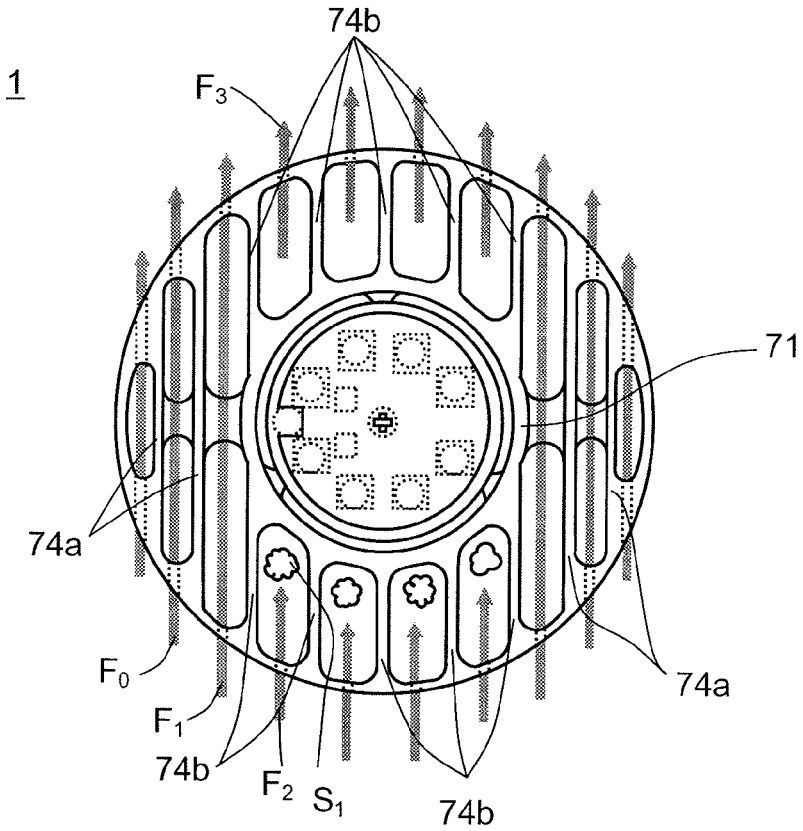
FIG. 6B is an elevational view of the illumination light source shown in FIG. 1, which illustrates the air streams during the lighting-up of the light source.

FIGS. 6A and 6B are views of illumination light source 1, which illustrate air streams during lighting-up of the light source. In the Figures, the downward direction on the paper sheets of the views refers to the vertically downward direction.

During the lighting-up of illumination light source 1, the heat is generated by light emitting module 10 which warms the air around illumination light source 1. As a result, air streams F0, F1, F2, and F3 occur which flow vertically upward. Because the plate surfaces of radiation fins 74*a* and 74*b* are along the vertical direction, the plate surfaces do not interfere with the air streams flowing vertically upward. For example, as shown in FIG. 6B, air streams F0, F1, and F3 can smoothly flow because the plate surfaces of radiation fins 74*b*, located on both sides of the air streams, are along the vertical direction. Moreover, air streams F0 and F1 are not interfered with by the outer wall of tube-like part 71, where air stream F0 flows through a gap between first radiation fins 74*a* and air stream F1 flows through a gap between first radiation fin 74*a* and second radiation fin 74*b*. For this reason, the warmed air does not stagnate in the gaps between first radiation fins 74*a* and the gaps between first radiation fins 74*a* and second radiation fins 74*b*. As a result, it is possible to efficiently radiate the heat generated from light emitting module 10.

Figure 7:
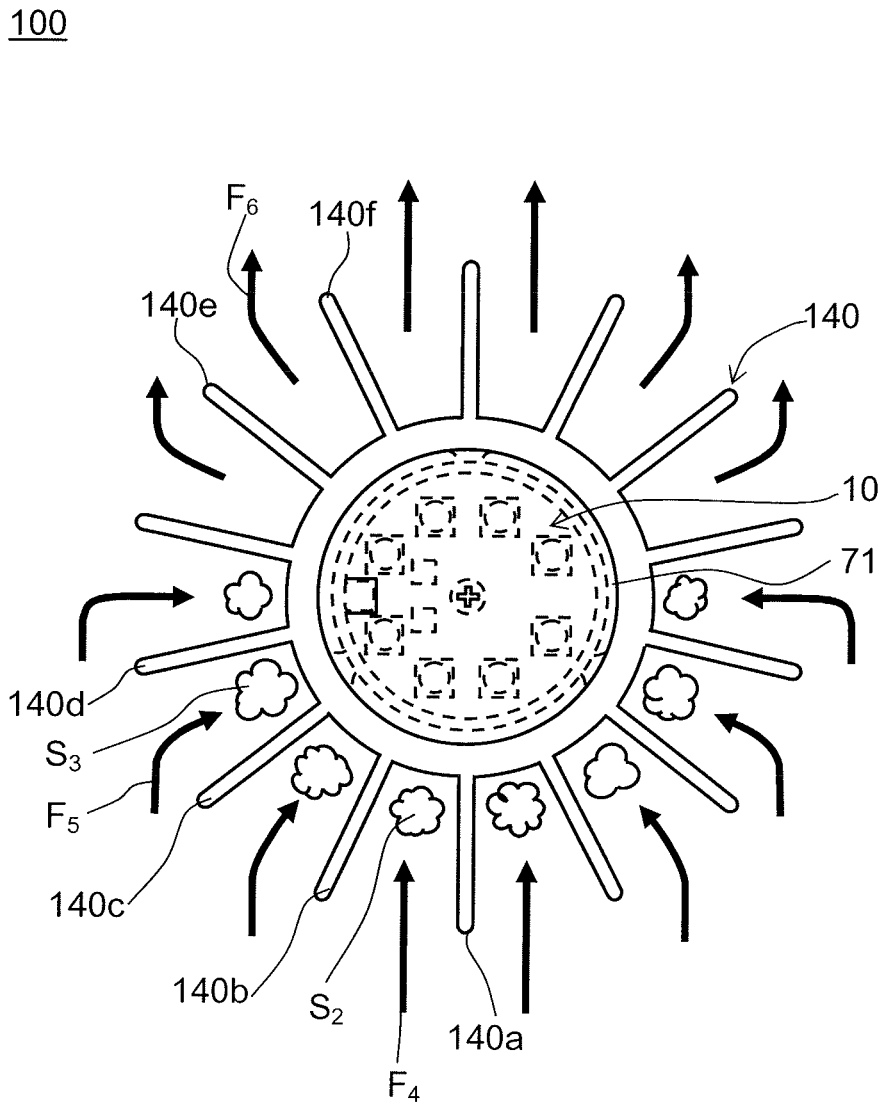
FIG. 7 is a view of an illumination light source of a Comparative Example, which illustrates air streams during lighting-up of the light source.

FIG. 7 is a view of illumination light source 100 of a Comparative Example, which illustrates air streams during lighting-up of the light source. Illumination light source 100 is different from illumination light source 1 in that a plurality of flat-plate radiation fins 140 is radially disposed on the outer wall of tube-like part 71. In the Figure, the downward direction on the paper sheet of the view refers to the vertically downward direction.

Both radiation fin 140*a* and radiation fin 140*b* are disposed at locations substantially vertically downward relative to the outer wall of tube-like part 71. Air stream F4, which flows into a gap between radiation fin 140*a* and radiation fin 140*b* disposed at the locations, is interfered with by the outer wall of tube-like part 71. For this reason, the air warmed via the heat exchange with radiation fin 140*a* and radiation fin 140*b*, is caused to stagnate in the gap between radiation fin 140*a* and radiation fin 140*b* (Cloud symbol S2).

When air flows into a gap between radiation fin 140*c* and radiation fin 140*d*, air stream F5 is necessary which has to climb over radiation fin 140*c* to flow into the gap. Therefore, it is difficult for the air to flow into the gap between radiation fin 140*c* and radiation fin 140*d*. Moreover, the stream of air warmed via the heat exchange is interfered with by the plate surface of radiation fin 140*d*. For this reason, the air warmed via the heat exchange is caused to stagnate in the gap between radiation fin 140*c* and radiation fin 140*d* (Cloud symbol S3).

Moreover, when the air flows out from a gap between radiation fin 140*e* and radiation fin 140*f*, air stream F6 is necessary which has to climb over radiation fin 140*f* to flow out. Therefore, it is difficult for the air to flow out from the gap between radiation fin 140*e* and radiation fin 140*f*.

As described above, illumination light source 1 includes light emitting module 10, circuit unit 20, base 40, case 30 (the first housing member), and radiation member 50 (the second housing member). Light emitting parts 12 are electrically coupled with circuit unit 20. Circuit unit 20 is electrically coupled with base 40. Case 30 has a tube-like shape, and accommodates circuit unit 20. Tube-like case 30 includes the openings at both ends thereof, and includes the light emitting module disposed in one of the openings and the base disposed in the other.

Radiation member 50 includes rotary ring body 84 and the plurality of plate-like radiation fins 74. Rotary ring body 84 has the rotation axis agreeing with center axis J of case 30. Plate-like radiation fins 74 are in parallel with one virtual plane A containing the rotation axis, and are disposed at intervals between each other in direction B orthogonal to plane A. In the combination of radiation member 50 and case 30, radiation member 50 is combined with case 30 such that the inner wall of rotary ring body 84 surrounds the outer wall of case 30. That is, radiation member 50 is rotatably attached to case 30, about center axis J.

It is noted that the rotation mechanism of radiation member 50 rotatable about center axis J may be adopted between radiation member 50 and case 30, as in the case of illumination light source 1. Alternatively, the rotation mechanism may be adopted in at least one of case 30 and radiation member 50.

In accordance with the configuration, even when illumination light source 1 is mounted at an inclination relative to the vertical direction, the plate surfaces of radiation fins 74 can be oriented along the vertical direction by rotating radiation member 50 about center axis J of case 30. This configuration permits a smooth flow of the warmed air. As to first radiation fins 74*a*, in particular, the air stream is not interfered with by the outer wall of tube-like part 71, which results in no stagnation of the warmed air, leading to the efficient heat exchange.

Note that, as shown in FIG. 6B, in illumination light source 1, second radiation fins 74*b* are disposed on the outer wall of tube-like part 71. With this configuration, air stream F2 which passes through a gap between second radiation fins 74*b* is interfered with by the outer wall of tube-like part 71. Therefore, the air warmed via the heat exchange with second radiation fins 74*b* is caused to stagnate in the gap between second radiation fins 74*b* (Cloud symbol S1). However, illumination light source 1 has a small amount of the space where such air-stagnation occurs, compared to illumination light source 100 of the Comparative Example. For this reason, illumination light source 1 has superiority in heat radiation over illumination light source 100 of the Comparative Example.

In illumination light source 1, the allowable number of rotation of radiation member 50 is restricted to be smaller than one. This can prohibit radiation member 50 from excessively rotating relative to case 30, thereby preventing disconnection of lead wires 24 from connection terminals 13 and connection terminals 23, and preventing breaking of lead wires 24.

The fin-surface area of each of radiation fins 74 is set to become smaller, with increasing the-center-to-fin distance in the direction orthogonal to plane A. This configuration renders illumination light source 1 similar in appearance to a halogen lamp (see FIG. 1). In addition, each of the gaps between radiation fins 74 is set to become narrower, with increasing the-center-to-fin distance in direction B orthogonal to plane A. This configuration secures a certain level of the heat radiation performance even at a location far away from plane A, i.e. the location where the areas of radiation fins 74 are small.

Radiation fins 74 are thermally coupled with each other via connection parts 75 and rim part 76, which allows heat transfer among radiation fins 74. Therefore, the heat generated by light emitting module 10 and the like is capable of dispersing over all of radiation fins 74 without uneven distribution in a part of radiation fins 74, resulting in the efficient heat exchange with outside air.

As shown in FIG. 2, the rotation axis of tube-like part 71 is agreeing with center axis J of case 30. Moreover, the plurality of light emitting parts 12 disposed on the upper surface of mounting substrate 11 is formed in a loop around the center axis of tube-like part 71. On light emitting module 10, it is the loop area that mainly emits light. Accordingly, even if radiation member 50 is rotated about center axis J of case 30, the area mainly emitting the light remains unchanged, on light emitting module 10. As a result, before and after the rotation of radiation member 50, there is no significant difference in light distribution characteristics of the light emitted from illumination light source 1.

Figure 8:
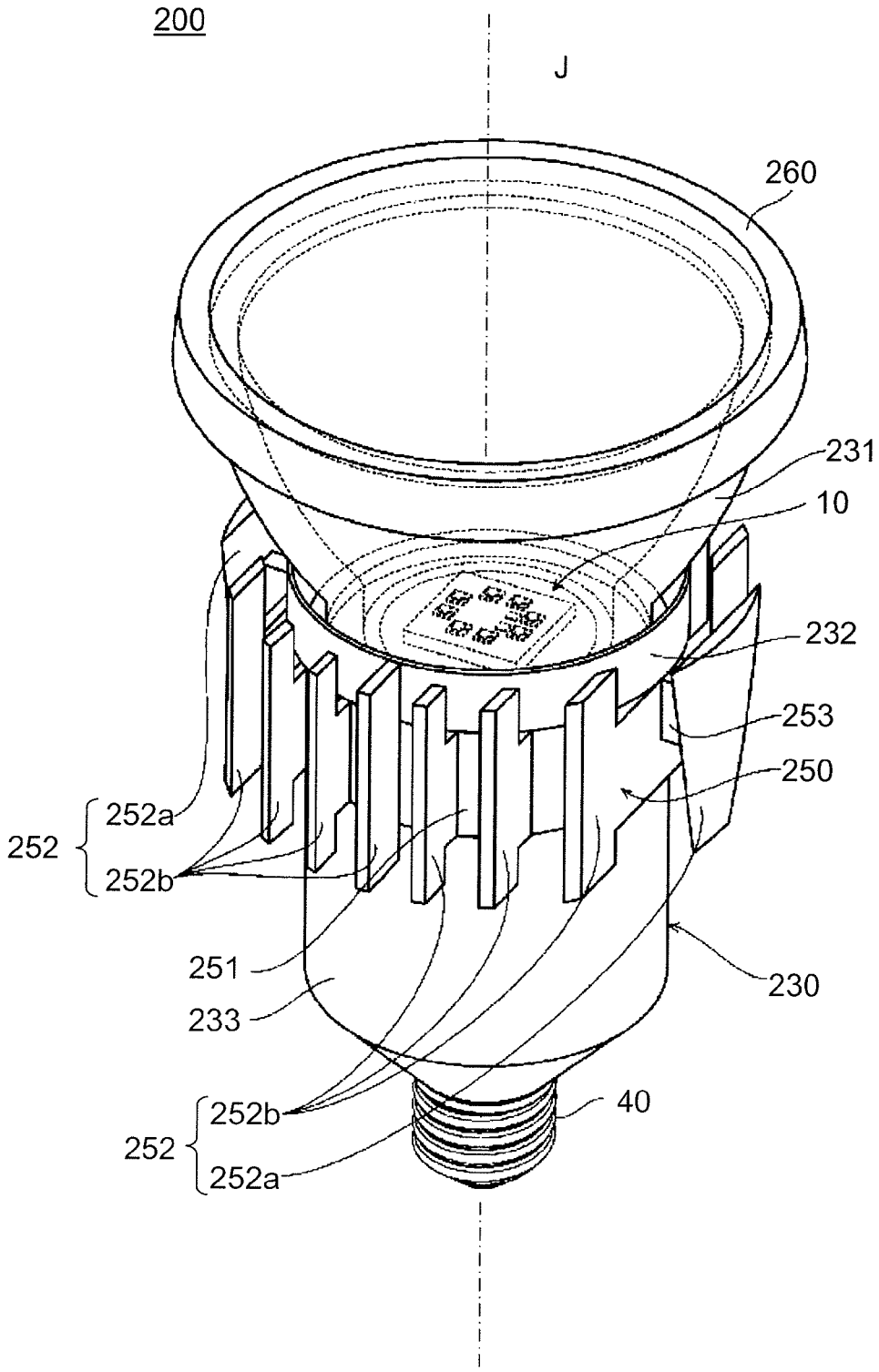
FIG. 8 is a perspective view of another illumination light source according to the embodiment.
Figure 9:
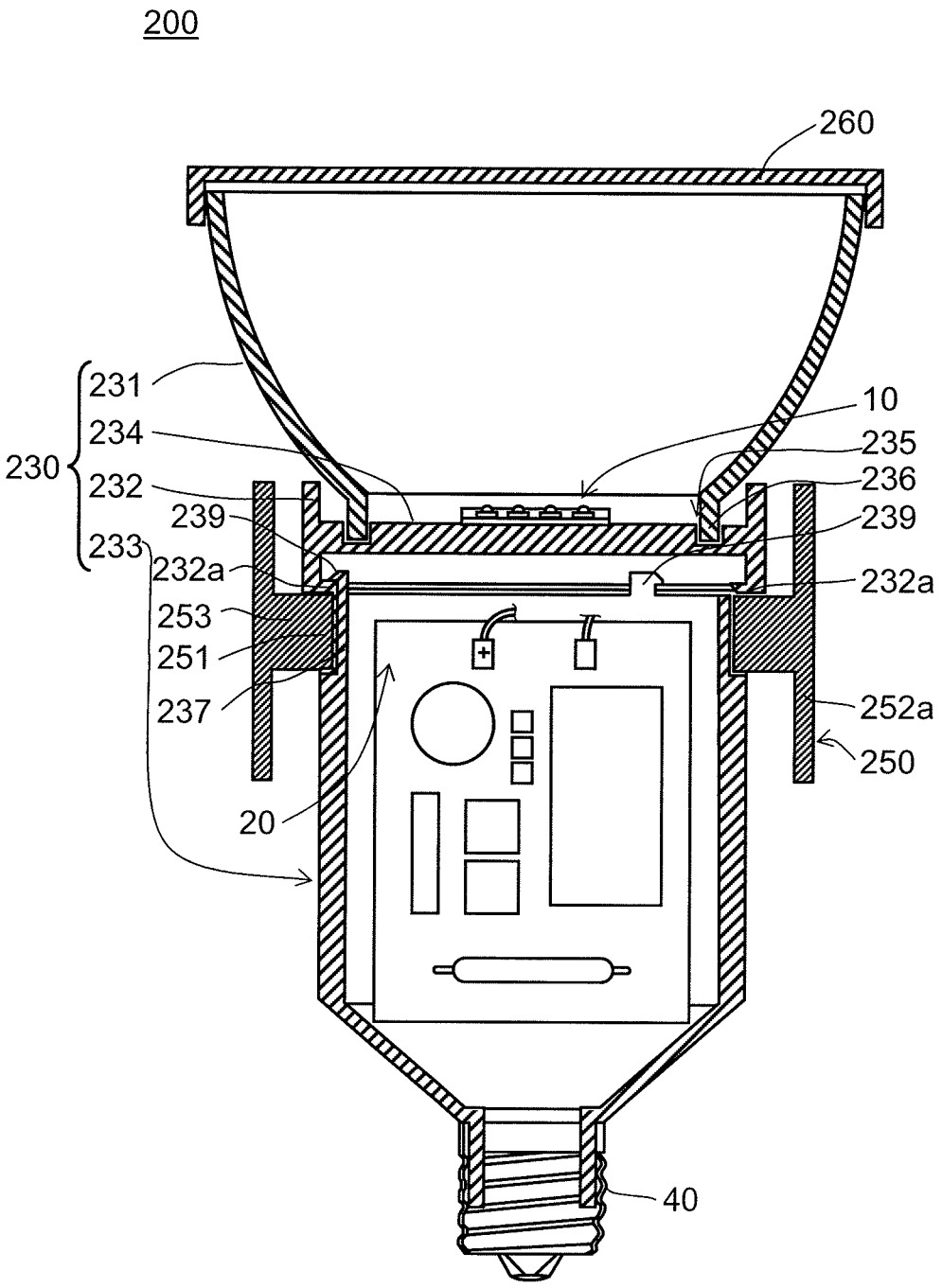
FIG. 9 is a cross-sectional side-elevation view of the another illumination light source shown in FIG. 8.

Next, descriptions will be made regarding illumination light source 200 of the embodiment, with reference to FIGS. 8 and 9. In illumination light source 1, radiation member 50 is disposed around the peripheral part of light emitting module 10. Instead of this, in illumination light source 200, radiation member 250 is disposed around the cylindrical part of case 230 which accommodates circuit unit 20. FIG. 8 is a perspective view of an appearance configuration of illumination light source 200. FIG. 9 is a cross-sectional side-elevation view of illumination light source 200. Illumination light source 200 includes light emitting module 10, circuit unit 20, case 230, base 40, radiation member 250, and cover 260. Case 230 serves as the first housing member. Radiation member 250 serves as the second housing member.

Illumination light source 200 is slightly different from illumination light source 1 in the structure of case 230. As shown in FIG. 9, case 230 is a tube-like body with center axis J, and includes light transmission member 231, first tube-like body 232, second tube-like body 233, and mounting plate 234.

Light transmission member 231 is configured with a translucent material such as a glass or a plastic material. The inner peripheral surface of light transmission member 231 is formed as a dichroic mirror composed with a deposited substance such as titanium. The dichroic mirror reflects light with a specific range of wavelengths to the front side of light transmission member 231 on the one hand, and passes light with the other range of wavelengths therethrough to the lateral outside of light transmission member 231 on the other hand.

Light emitting module 10 is mounted on mounting plate 234. In mounting plate 234, annular ring-like groove 235 is formed to surround light emitting module 10. One-end opening part 236 of light transmission member 231 is inserted into groove 235 to be joined with mounting plate 234 with an adhesive (not shown) charged in groove 235.

In second tube-like body 233, as shown in FIG. 9, small-diameter part 237 with a predetermined diameter is formed at the body's end portion located opposite to base 40. From the end of the small-diameter part, claws 239 protrude in the direction opposite to base 40. Although only two of claws 239 are shown in FIG. 9, three claws 239 are actually disposed at regular intervals on the circumference of small-diameter part 237.

As shown in FIG. 8, in illumination light source 200 as in the case of illumination light source 1, a plurality of radiation fins 252 which is arranged in parallel with each other is disposed on the outer wall of rotary ring body 251, i.e. the tube-like part. Of the plurality of radiation fins 252 excluding radiation fins 252*a* located at both ends, each of radiation fins 252*b* is disposed to protrude from the outer wall of rotary ring body 251. Radiation fins 252*a* at both ends are disposed on rotary ring body 251 via connection parts 253, at locations outward away from the circumferential surface of rotary ring body 251. Rotary ring body 251 is rotatably fitted onto small-diameter part 237 of second tube-like body 233 of case 230.

It is only three of claws 239 that are disposed on the circumference of small-diameter part 237 of second tube-like body 233 shown in FIG. 9. This number of three renders the claws capable of being bent inward when first tube-like body 232 is fitted into small-diameter part 237, which is operative to increase the workability of assembling of radiation member 250.

Onto small-diameter part 237, one end of first tube-like body 232 is fitted together with rotary ring body 251. On the inner peripheral surface of the one end of first tube-like body 232, projected rim 232*a* is formed. Onto projected rim 232*a*, claws 239 are fitted to fix first tube-like body 232 to second tube-like body 233. It is noted, however, that the diameter of projected rim 232*a* is smaller than that of small-diameter part 237, which causes projected rim 232*a* to abut on small-diameter part 237, thereby restricting the rotation of first tube-like body 232 relative to second tube-like body 233.

In illumination light source 200, radiation member 250 is disposed around the cylindrical part of case 230 with a substantially cylindrical shape, whereas radiation member 250 is not disposed around the axis of light transmission member 231. This configuration allows the light having passed through the side surface of light transmission member 231 to travel to the outside.

Moreover, in illumination light source 200, even when case 230 is attached at an inclination relative to the vertical direction, all radiation fins 252 can be arranged to orient their plate surfaces in the direction along the vertical direction, by rotating radiation member 250 about center axis J of case 230. It is noted that, in illumination light source 200, since light emitting module 10 is fixed to case 230, the rotation of radiation member 250 relative to case 230 does not cause light emitting module 10 to rotate. For this reason, before and after the rotation of radiation member 250, the distribution characteristics of the light emitted from illumination light source 200 remains unchanged.

Figure 10:
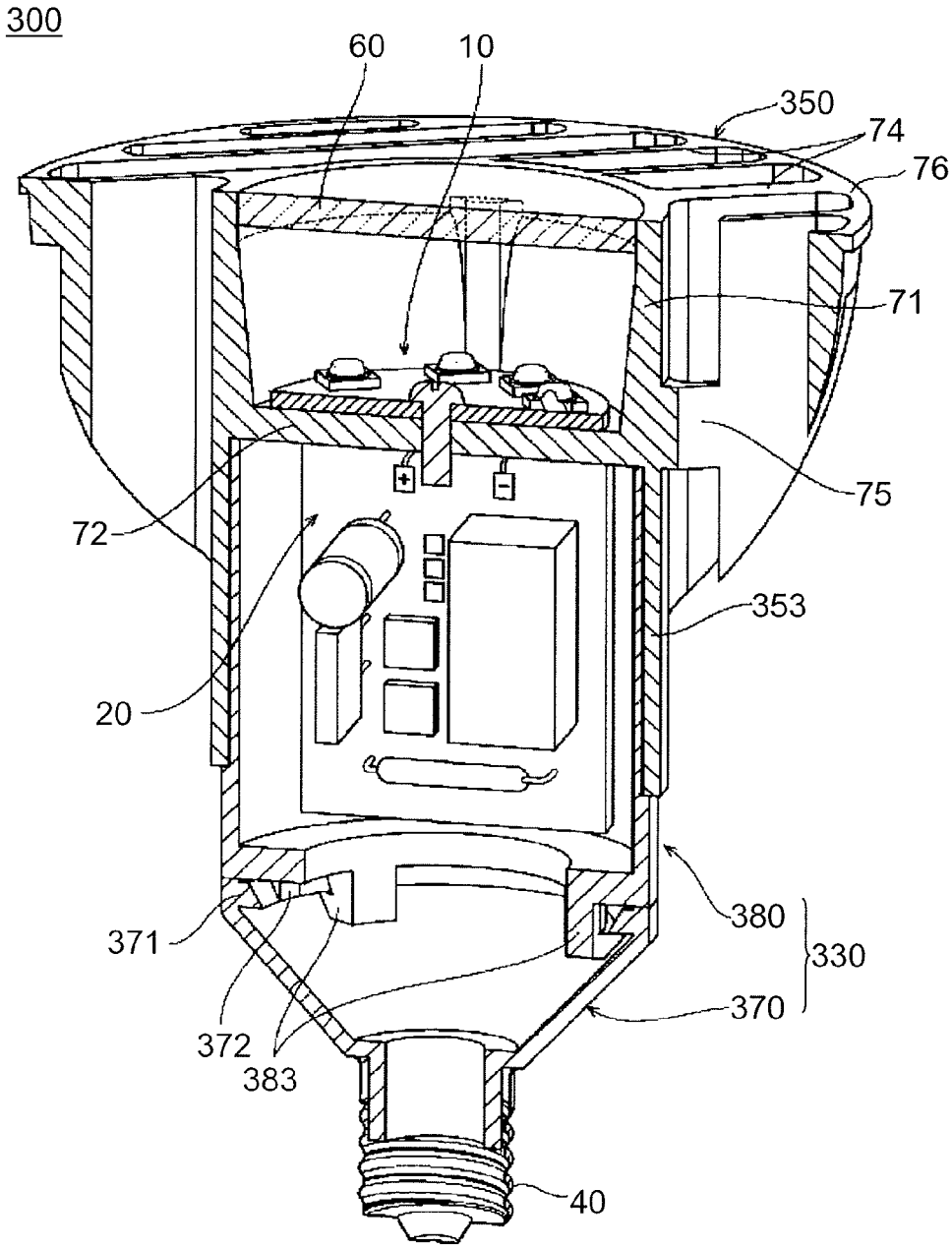
FIG. 10 is a perspective cross-sectional view of further another illumination light source according to the embodiment.

Next, illumination light source 300 according to the embodiment will be described with reference to FIG. 10. FIG. 10 is a perspective cross-sectional view of illumination light source 300. Case 330 serves as the first housing member. Radiation member 350 serves as the second housing member. Illumination light source 300 is different from illumination light source 1, in the location of the rotation mechanism.

Specifically, in illumination light source 1, the rotation mechanism is adopted between radiation member 50 and case 30 that accommodates circuit unit 20. In contrast, in illumination light source 300, case 330 is configured with two members, i.e. first case member 370 and second case member 380, and the rotation mechanism is adopted between first case member 370 and second case member 380. That is, the rotation mechanism is adopted in case 330.

As shown in FIG. 10, case 330 of illumination light source 300 includes cone-shaped first case member 370 and tube-like second case member 380.

First case member 370 is mounted to a lighting fixture (not shown) via base 40 that is attached to the end part of the case member.

Onto the outer periphery of second case member 380, tube-like rotary ring body 353 is fitted which is formed at one end of radiation member 350. The outer wall of second case member 380 is fastened, with an adhesive, to the inner peripheral surface of rotary ring body 353, thereby fixing radiation member 350 to case 330.

The connection portion between first case member 370 and second case member 380 is as follows: That is, claws 383 are formed to protrude from a one-end peripheral surface of second case member 380 (Although only two of claws 383 are shown in FIG. 10, three claws are actually formed). Claws 383 are inserted into reduced-inner-diameter ring part 371 that is formed in a one-end peripheral surface of first case member 370, thereby locking second case member 380 on first case member 370. By appropriately forming both the outer diameter of claws 383 and the inner diameter of reduced-inner-diameter ring part 371, it allows the rotatable coupling between first case member 370 and second case member 380. With this configuration, both radiation member 350 and second case member 380 are rotatable with respect to first case member 370 that is mounted to the lighting fixture (not shown).

Note that, on the outer wall of reduced-inner-diameter ring part 371, stopper 372 is formed to restrict the allowable range of rotation of second case member 380, thereby restricting the allowable range of rotation of radiation member 350.

Moreover, both first case member 370 and second case member 380 of case 330 are configured with a resin to render the both capable of bending flexibly when being coupled with each other, resulting in an increase in ease of the assembling work.

Next, illumination light source 400 according to the embodiment will be described with reference to FIGS. 11 and 12. Case 430 serves as the first housing member. Radiation member 450 serves as the second housing member. Illumination light source 400 is different from illumination light source 1 in the mechanism to restrict the movement of radiation member 450 in both directions of center axis J. In illumination light source 1, the movement of radiation member 50 in both directions of center axis J is restricted by sandwiching large-diameter part 31 of case 30 by radiation member 50 configured with the first radiation member and the second radiation member. In contrast, the movement of radiation member 450 is restricted in both directions of center axis J, by sandwiching radiation member 450 by both cover 470 and large-diameter part 432 of case 430.

Figure 11:
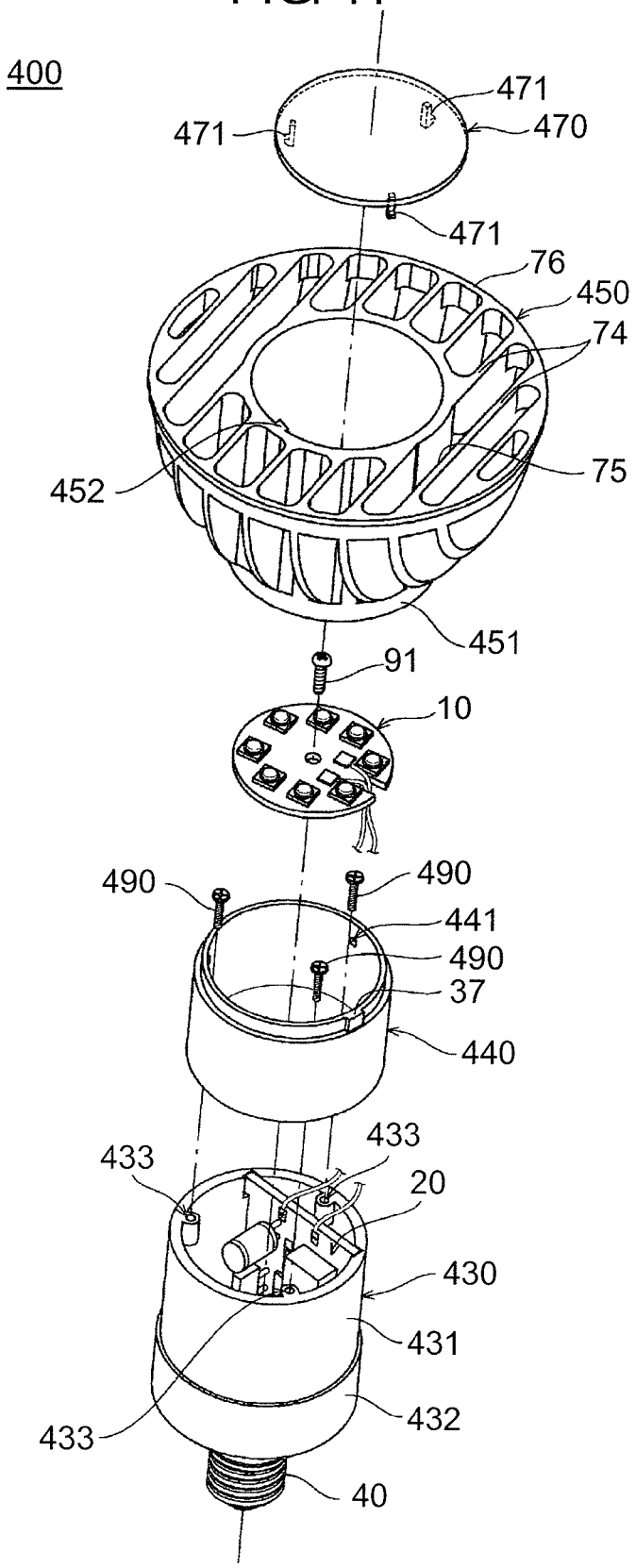
FIG. 11 is an exploded perspective view of each of members which configure yet further another illumination light source according to the embodiment.

FIG. 11 is an exploded perspective view of each of members which configure illumination light source 400. Illumination light source 400 includes light emitting module 10, circuit unit 20, case 430, base 40, light-source accommodating part 440, radiation member 450, and cover 470.

Figure 12:
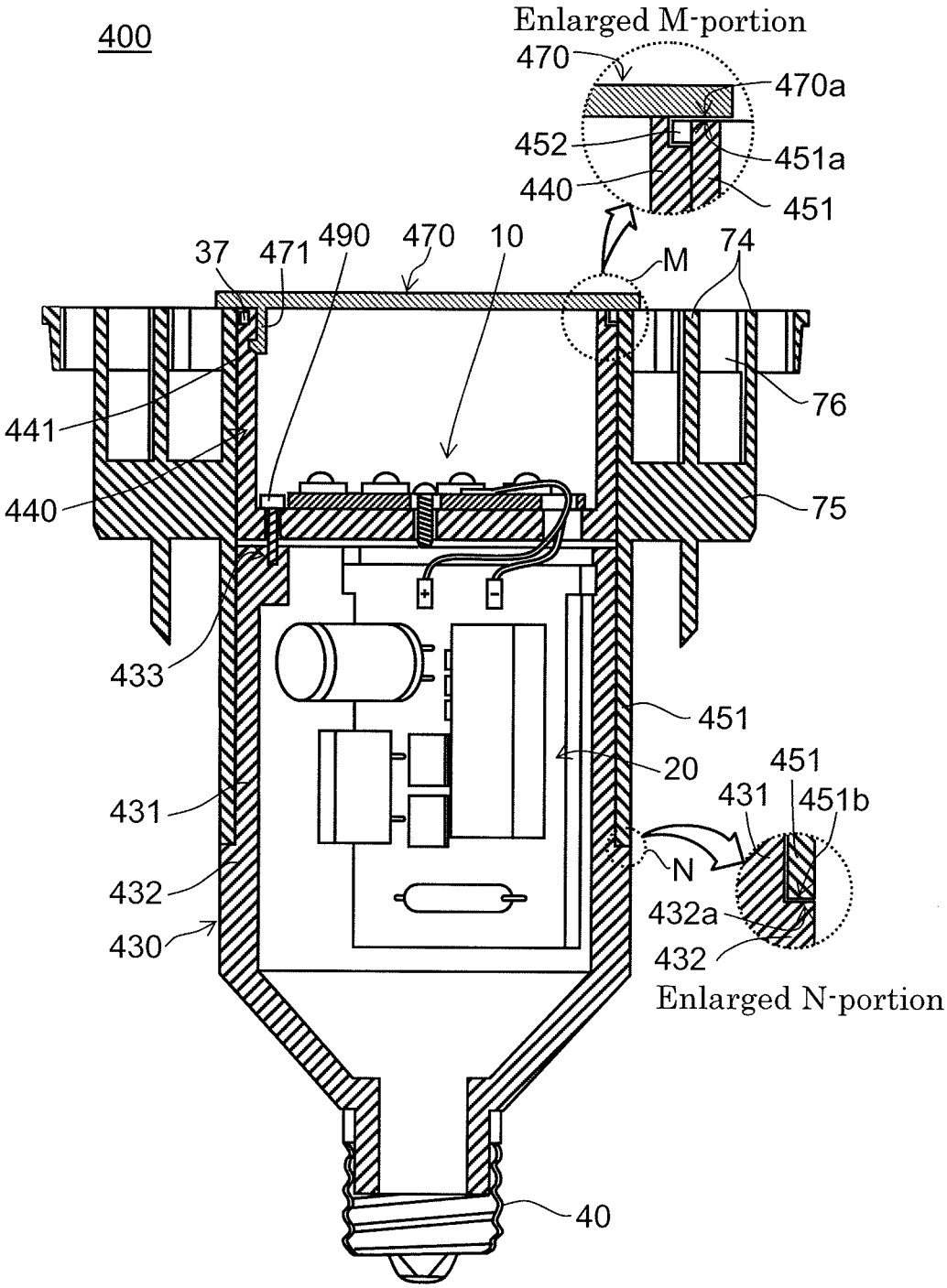
FIG. 12 is a cross-sectional, side-elevational view of the yet further another illumination light source shown in FIG. 11.

As can be seen from the Figure, radiation member 450 is an integrally-molded article, and tube-like rotary ring body 451 at the center of the radiation member is rotatably fitted onto both case 430 and light-source accommodating part 440 (see FIG. 12).

In case 430, small-diameter part 431 is formed having a predetermined length starting from the one end opposite to base 40. The outer diameter of small-diameter part 431 is approximately agreeing with the outer diameter of light-source accommodating part 440.

Cover 470 is a disk-like member to cover an opening of light-source accommodating part 440. On cover 470, a plurality (three in the embodiment) of locking projections 471 is formed. Locking projections 471 are respectively fitted into recesses 441 that are formed in the inner peripheral surface of light-source accommodating part 440, thereby fixing cover 470 to light-source accommodating part 440.

When illumination light source 400 is assembled, firstly, screws 490 are inserted into holes (not shown in FIG. 11) that are formed in a peripheral part of the bottom wall of light-source accommodating part 440. Then, screws 490 are screwed into screw holes 433 that are formed in the end surface of case 430, thereby fixing light-source accommodating part 440 to case 430. Then, radiation member 450 is inserted from one end of light-source accommodating part 440 such that radiation member 450 is fitted onto both small-diameter part 431 of case 430 and the outer side of light-source accommodating part 440. After that, locking projections 471 of cover 470 are fitted into recesses 441 of light-source accommodating part 440, thereby fixing cover 470 to light-source accommodating part 440.

FIG. 12 is a cross-sectional view of illumination light source 400. As shown in the inserted enlarged view of N-portion in the Figure, end surface 451*b* of radiation member 450 faces end surface 432*a* of large-diameter part 432 of case 430. Moreover, as shown in the inserted enlarged view of M-portion in the Figure, end surface 451*a* of radiation member 450 faces end surface 470*a* of cover 470. In this way, since radiation member 450 is sandwiched between cover 470 and large-diameter part 432 of case 430, the movement of radiation member 450 is restricted in both directions of center axis J relative to case 430.

It is noted that, on the inner peripheral surface of rotary ring body 451 of radiation member 450, one restriction part 452 is formed to restrict the rotation. On the other hand, on an end part of light-source accommodating part 440, one stopper 37 is formed to restrict the allowable range of rotation of radiation member 450. With this configuration, the allowable range of rotation of radiation member 450 is restricted, at the location different from that in illumination light source 1.

Next, illumination light source 500 according to the embodiment will be described, with reference to FIGS. 13 and 14. Case 30 serves as the first housing member, while radiation member 550 serves as the second housing member. Illumination light source 500 is different from illumination light source 1 in that pass-through parts for ventilation are formed in some of the radiation fins.

Figure 13:
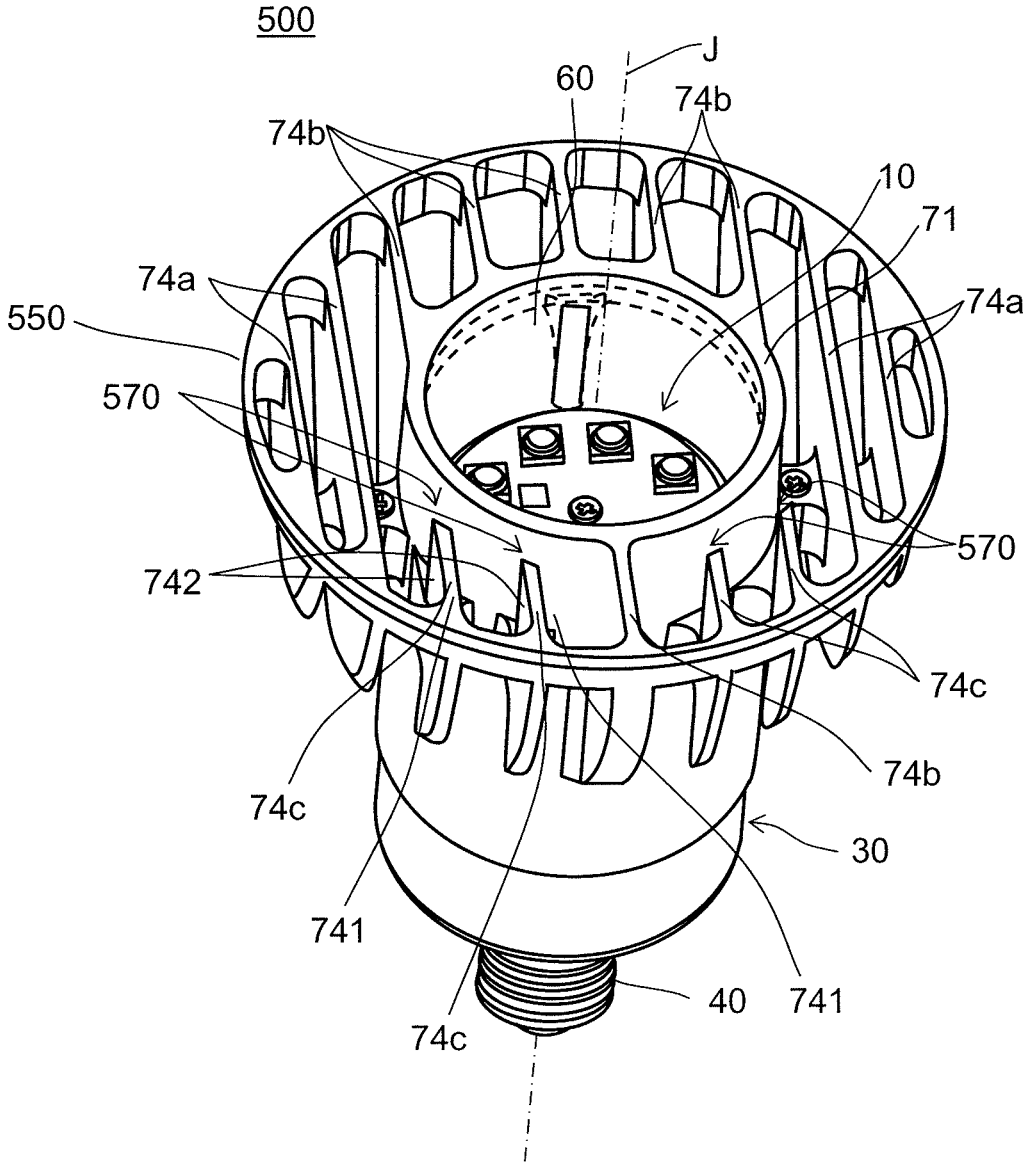
FIG. 13 is a perspective view of another illumination light source according to the embodiment.

FIG. 13 is a perspective view of illumination light source 500. Illumination light source 500 includes first radiation fins 74*a*, second radiation fins 74*b*, and third radiation fins 74*c*. In third radiation fins 74*c*, pass-through parts 570 for ventilation are formed to pass air from first principal faces 741 to second principal faces 742. That is, of the plurality of the radiation fins, at least one of the radiation fins is provided with pass-through part 570.

Figure 14:
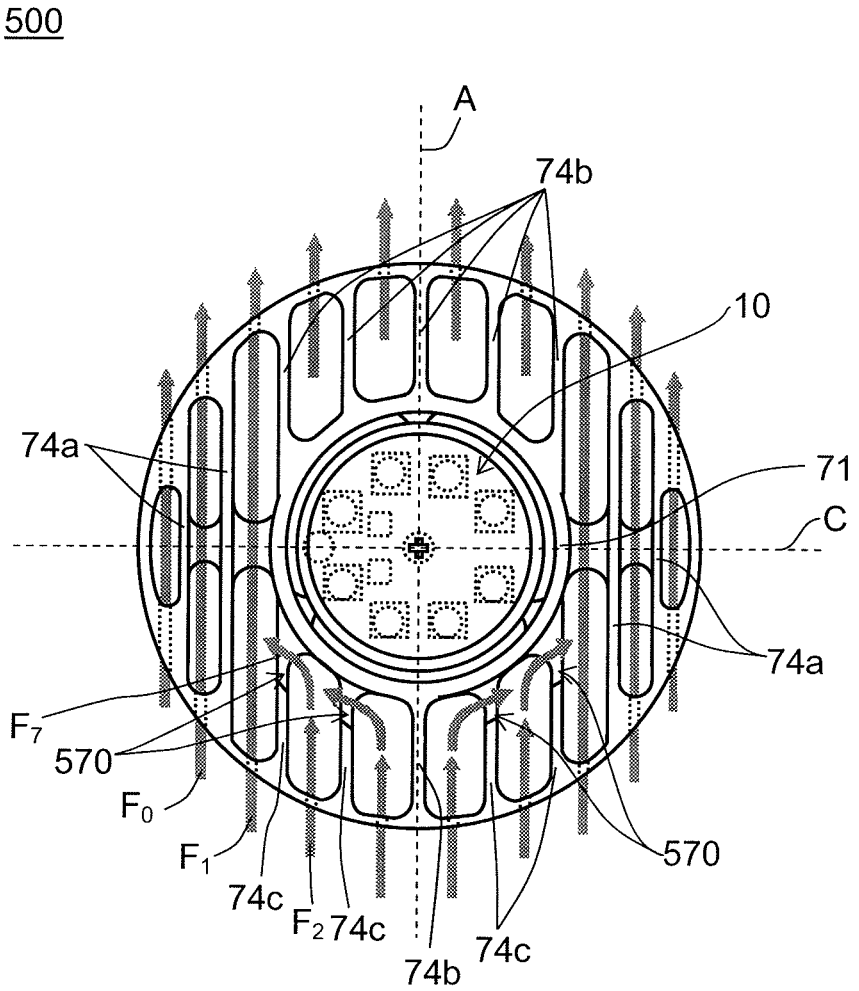
FIG. 14 is an elevational view of the another illumination light source shown in FIG. 13, which illustrates air streams during lighting-up of the light source.

As shown in the elevational view of FIG. 14, when it is assumed that boundary plane C refers to a virtual plane which includes center axis J and is orthogonal to plane A, there are two regions which are disposed on the outer wall of tube-like part 71 and are partitioned by boundary plane C. With this assumption, third radiation fins 74*c* are present only in one of the two regions.

In illumination light source 500, when the orientation of the radiation fins is adjusted such that third radiation fins 74*c* are located on the vertically lower side, air streams F7 occur which pass through pass-through parts 570, in addition to the air streams in illumination light source 1. Specifically, after each of air streams F2 passing through between third radiation fins 74*c* has impinged against the outer wall of tube-like part 71, the air stream passes through pass-through part 570 to merge with air stream F1 passing through between first radiation fin 74*a* and third radiation fin 74*c*. With this configuration, it is possible to suppress the occurrence of the air stagnation indicated by Cloud symbol S1 of FIG. 6B.

Next, illumination light source 600 according to the embodiment will be described with reference to FIG. 15. Case 30 serves as the first housing member, while radiation member 650 serves as the second housing member. Illumination light source 600 is different from illumination light source 500 in that thicknesses of some of the plurality of the radiation fins are different from those of the other radiation fins.

Figure 15:
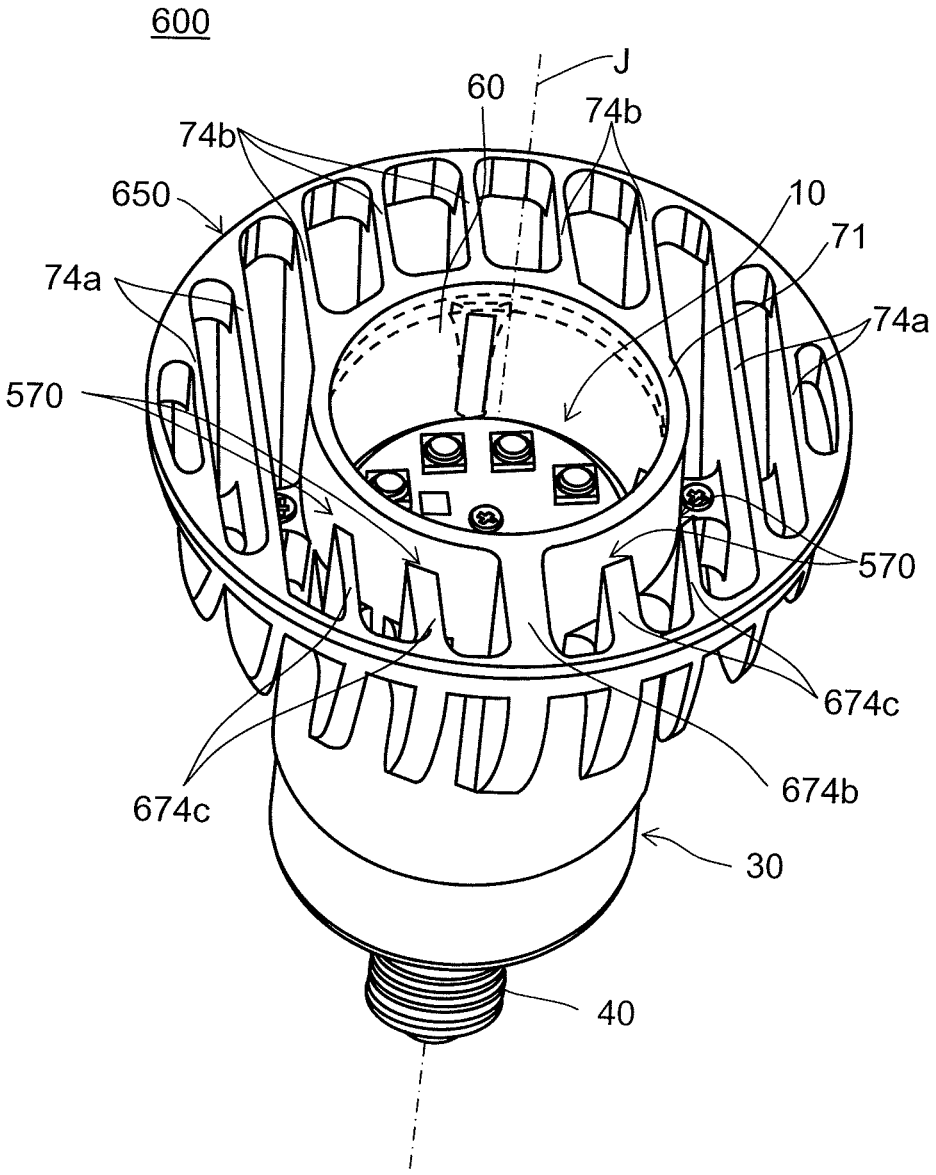
FIG. 15 is a perspective view of further another illumination light source according to the embodiment.

FIG. 15 is a perspective view of illumination light source 600. Illumination light source 600 includes first radiation fins 74*a*, second radiation fins 74*b*, third radiation fins 674*c*, and fourth radiation fin 674*b*. Third radiation fins 674*c* are identical to third radiation fins 74*c* in illumination light source 500, except that their thicknesses are made larger. In addition, fourth radiation fin 674*b* is identical to second radiation fin 74*b* in illumination light source 500, except that its thickness is made larger.

In order for pass-through parts 570 to play a role in suppressing the air stagnation, the orientation of the radiation fins is required to be adjusted such that the radiation fins having pass-through parts 570 are located on the vertically lower side. However, when pass-through parts 570 are merely formed in the radiation fins, it causes the radiation fins having pass-through parts 570 to become light in weight. This causes a shift of the center of gravity of radiation member 650 out of the center axis, toward the direction opposite to the direction in which pass-through parts 570 are formed. For this reason, when the orientation of the radiation fins is adjusted such that the radiation fins having pass-through parts 570 are located on the vertically lower side, the center of gravity of radiation member 650 comes to a location vertically upward from the center axis. With this configuration, in case illumination light source 600 should be subjected to an impact of something or vibrations from something, there is a possibility that the radiation member rotates to change the orientation of the radiation fins, due to the displacement of the center of gravity as describe above.

Consequently, in illumination light source 600, the thicknesses of third radiation fins 674*c* and fourth radiation fin 674*b* are made larger, which are located in a region where pass-through parts 570 are formed. With this configuration, in plane A, the position of the center of gravity of radiation member 650 is shifted from rotation axis J toward the direction in which fourth radiation fin 674*b* with the larger thickness is located. That is, the center of gravity of radiation member 650 is located in a region on one side away from rotation axis J, in plane A. For this reason, after a user has adjusted the orientation of the radiation fins such that third radiation fins 674*c* are located on the vertically lower side, there is a remote possibility that the radiation fins will change the orientation on their own accord.

Moreover, in the case where a lubricant such as grease or lubricating oil is applied to reduce the coefficient of friction between radiation member 650 and case 30, when illumination light source 600 is mounted at an inclination relative to the vertical direction, radiation member 650 rotates on its own about center axis J relative to case 30, due to the displacement of the center of gravity of radiation member 650. Then, at a time when the line connecting between center axis J and the center of gravity comes to point toward the vertical direction, radiation member 650 terminates its rotation. At this time, the plate surfaces of radiation fins 74*a*, 74*b*, 674*c*, and 674*b* are along the vertical direction. In addition, third radiation fins 674*c* are located on the vertically lower side. In this way, there is no need for the user to perform the adjustment of illumination light source 600 for a better efficiency, which provides greater convenience for the user.

It is noted, however, that techniques other than the use of lubricant may be employed to reduce the coefficient of friction between radiation member 650 and case 30. For example, a bearing may be disposed between radiation member 650 and case 30 to reduce the coefficient of friction between radiation member 650 and case 30.

Next, illumination light source 700 according to the embodiment will be described with reference to FIGS. 16 to 17B. Case 30 serves as the first housing member, while radiation member 750 serves as the second housing member. Illumination light source 700 is different from illumination light source 1 in the structure of the radiation member. Specifically, in the plates of some of the radiation fins, light-through holes are formed to pass the light emitted from the light emitting module.

Figure 16:
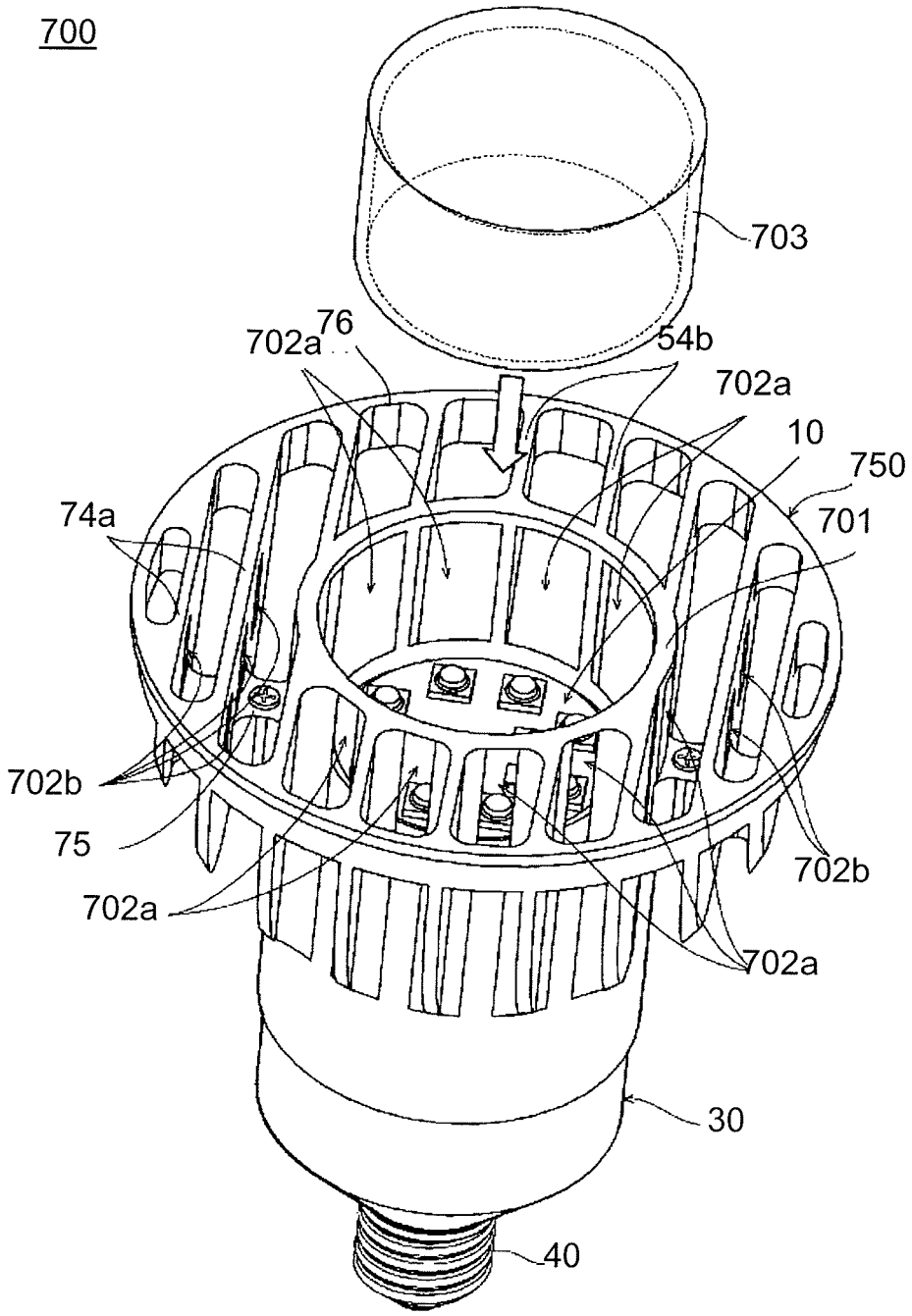
FIG. 16 is a perspective view of yet further another illumination light source according to the embodiment.

FIG. 16 is a perspective view of illumination light source 700. In first tube-like part 701 of radiation member 750, a plurality of first light-through holes 702*a* is formed to pass the light emitted from light emitting module 10. Into first tube-like part 701, translucent cap 703 is fitted. Cap 703 covers light emitting module 10 to prevent the entry of foreign substances including water into emitting module 10.

In the plates of first radiation fins 74*a* of radiation member 750, a plurality of second light-through holes 702*b* is formed to pass the light emitted from light emitting module 10, after the light has passed through first light-through holes 702*a* of first tube-like part 701.

Figure 17A:
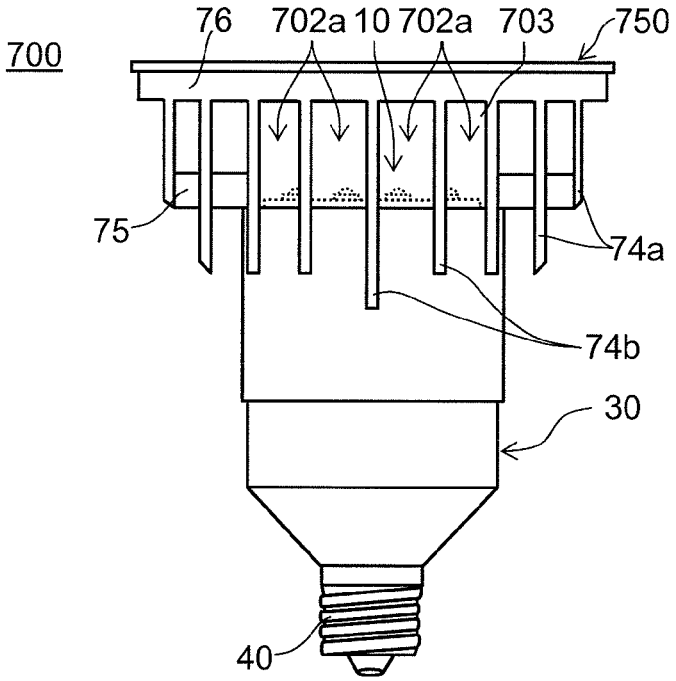
FIG. 17A is a side-elevational view of an appearance of the yet further another illumination light source shown in FIG. 16.

As shown in FIG. 17A, when illumination light source 700 is viewed from the direction parallel to the radiation fins, first light-through holes 702*a* of first tube-like part 701 can be observed through between second radiation fins 74*b*. This means that part of the light emitted from light emitting module 10 can pass through first light-through holes 702*a*, and further through between second radiation fins 74*b* to travel to the outside. That is, in first tube-like part 701, first light-through holes 702*a* are each formed between adjacent two radiation fins 74*b* of the plurality of second radiation fins 74*b*, in the direction of traveling of the light emitted from emitting part 12.

Figure 17B:
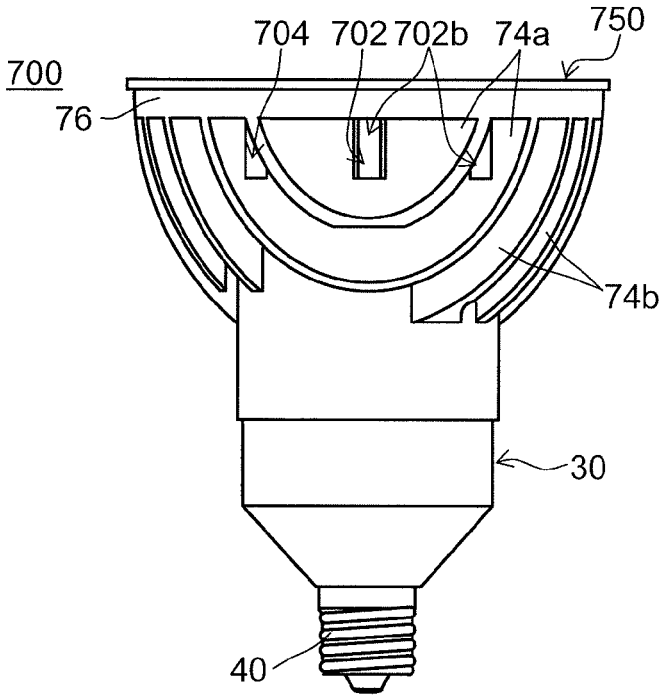
FIG. 17B is a side-elevational view of the appearance of the yet further another illumination light source shown in FIG. 17A, as viewed from a 90-degree-turned position.

On the other hand, as shown in FIG. 17B, first light-through holes 702*a* of first tube-like part 701 are shielded by the plate surfaces of first radiation fins 74*a*, thereby being unable to be observed when viewed from the direction perpendicular to the radiation fins, unless any action is taken against the problem. Therefore, the light emitted from light emitting part 12 is blocked by the plate surfaces of first radiation fins 74*a*.

To address this problem, in illumination light source 700, there is formed a plurality of light-through parts 704 in the plates of first radiation fins 74*a* so as to pass the light emitted from light emitting module 10. Through light-through parts 704, first light-through holes 702*a* of first tube-like part 701 can be observed. Consequently, it makes it possible to allow the light, emitted in the direction in which first radiation fins 74*a* are disposed, to travel to the outside. As a result, it is possible to increase the amount of the light emitted from the side surface of illumination light source 700 to the outside. That is, in first radiation fins 74*a* located in direction B from the rotation axis, second light-through holes 702*b* are formed in the direction of traveling of the light emitted from light emitting part 12.

MODIFIED EXAMPLES

It should be noted that, although the descriptions have been made based on the various embodiments described above, the present disclosure is obviously not limited to the various embodiments. The following cases are also within the scope of the present disclosure. Note, however, that constituent elements common to illumination light source 1 are designated by the same numerals and symbols as those of illumination light source 1, and their descriptions will be simplified or omitted.

In the various embodiments, the descriptions have been made for the examples where the mechanism to restrict the allowable range of rotation of the radiation member is adopted in the radiation member and the case; however, the present disclosure is not necessarily limited to the examples. For example, instead of the aforementioned mechanism to restrict the allowable range of the rotation, a mechanism may be adopted which restricts the rotational direction of the radiation member to one-way only.

Figure 18:
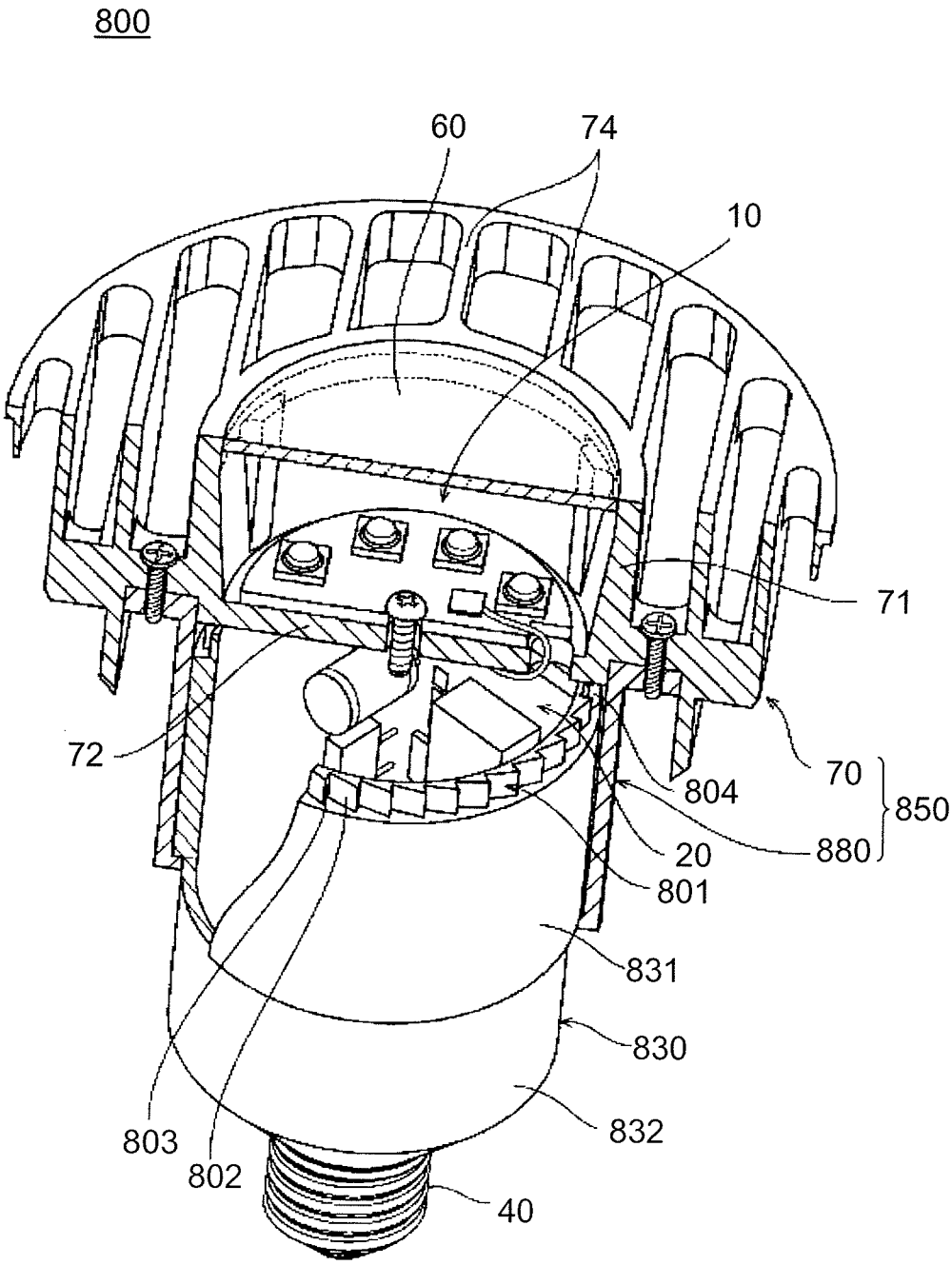
FIG. 18 is a partial cross-sectional view of an illumination light source of Modified Example 1 according to the embodiment.

FIG. 18 is a partial cross-sectional view of illumination light source 800 of Modified Example 1. In an end part of large-diameter part 831 of case 830, gear 801 is disposed. The tooth flank of each of the teeth of gear 801 includes slope part 802 and step part 803.

Figure 19:
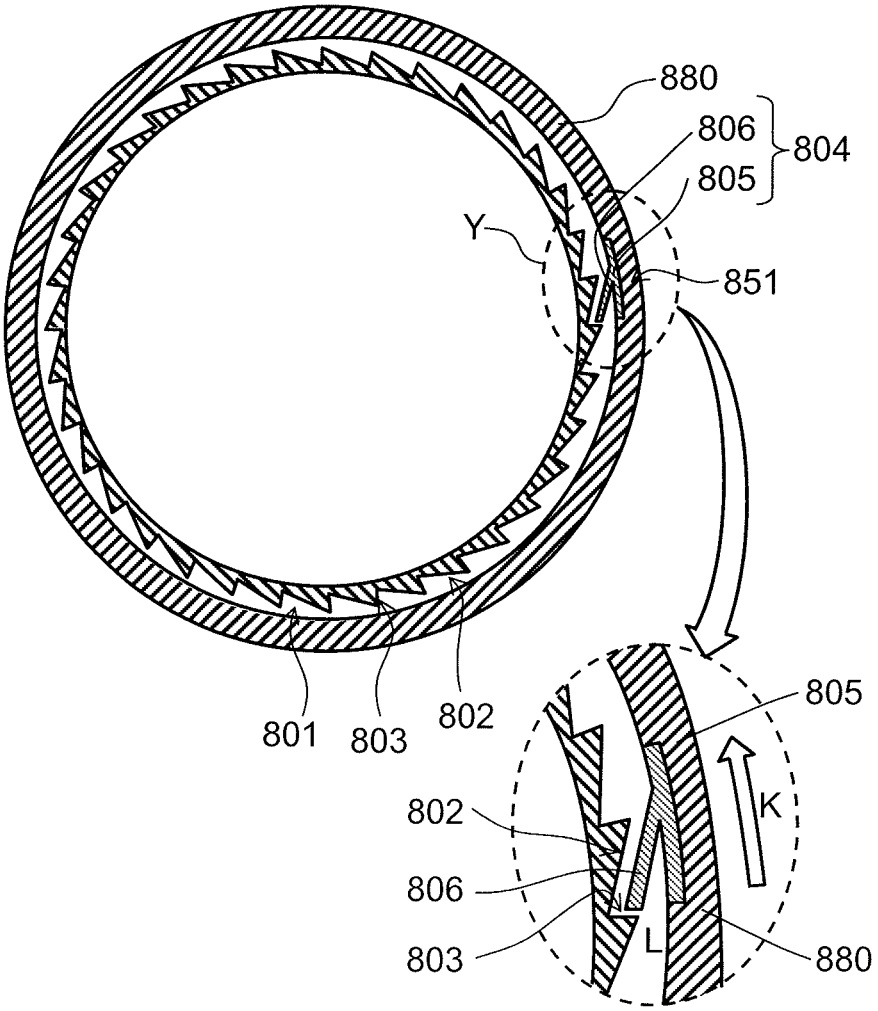
FIG. 19 is a cross-sectional view of the illumination light source shown in FIG. 18, taken along a plane orthogonal to the center axis of a case.

FIG. 19 is a cross-sectional view of illumination light source 800, taken along a plane orthogonal to center axis J of case 30. On the inner peripheral surface of second member 880 of radiation member 850, pawl part 804 is disposed which is configured with an elastic body such as resin. In the inner peripheral surface of second member 880, recess 851 is formed. Fit-in piece 805 of pawl part 804 is fastened, with an adhesive, with the fit-in piece fitting into recess 851, which results in the fixation of pawl part 804 to second member 880.

Projection piece 806 of pawl part 804 is disposed at an inclination, in a plan view, relative to the direction orthogonal to the inner peripheral surface of second member 880. As shown in the inserted enlarged view of Y-portion in the Figure, when second member 880 is applied with a counterclockwise force (arrow K), projection piece 806 comes in contact with slope part 802 of gear 801 to bend toward the direction of arrow L, thereby climbing over slope part 802 of gear 801. Therefore, radiation member 850 can move in the counterclockwise direction. In contrast, when second member 880 is applied with a clockwise force, projection piece 806 engages with step part 803 of gear 801. As a result, radiation member 850 cannot move in the clockwise direction. That is, in the rotation mechanism, gear 801 and pawl part 804 serve as the restriction part to restrict the rotation.

In this way, because the rotation of radiation member 850 is restricted only to the counterclockwise rotation, the clockwise force applied to radiation member 850 is conveyed to case 30. For this reason, when the user screws base 40 of illumination light source 800 into socket 97, the user is required to apply a clockwise force to radiation member 850. On the other hand, when adjusting the orientation of radiation fins 74, the user is required to apply a counterclockwise force to radiation member 850.

In the various embodiments described above, the descriptions have been made for the examples where the light emitting module is electrically coupled with the circuit unit by using the lead wires that connect between the connection terminals of the light emitting module and the connection terminals of the circuit unit. However, the present disclosure is not necessarily limited to the examples. For example, a slip-ring mechanism may be adopted to provide the electrical coupling between the connection terminals of the light emitting module and the connection terminals of the circuit unit.

Figure 20:
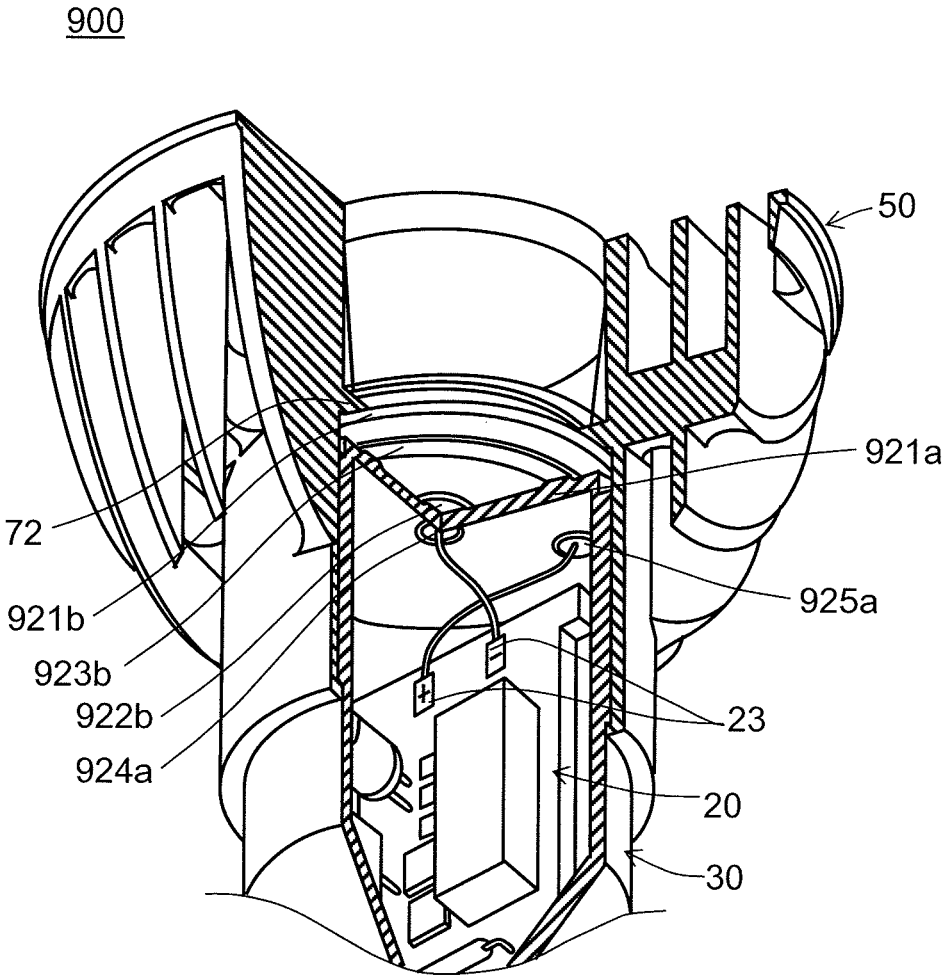
FIG. 20 is a partial cross-sectional view of an illumination light source of Modified Example 2 according to the embodiment.
Figure 21:
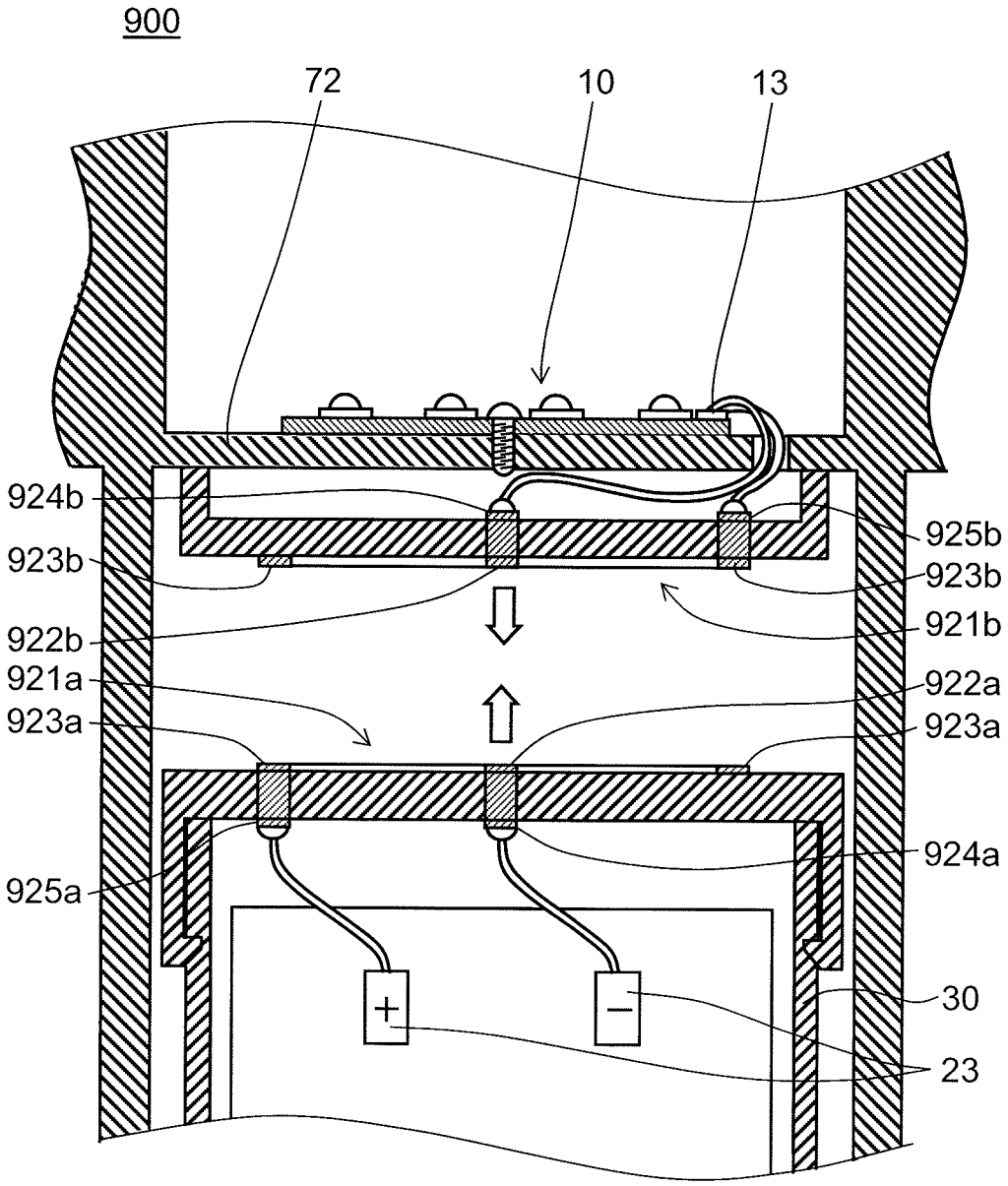
FIG. 21 is a cross-sectional, side-elevational view of the illumination light source shown in FIG. 20.

FIG. 20 is a partial cross-sectional view of illumination light source 900 of Modified Example 2. FIG. 21 is a cross-sectional, side-elevational view of illumination light source 900. Above case 30 to accommodate circuit unit 20 and below bottom plate 72 to mount light emitting module 10 thereon, electric connecting plates 921*a* and 921*b* are disposed, respectively.

On principal faces on one sides of electric connecting plates 921*a* and 921*b*, a pair of first conduction paths 922*a* and 922*b* is formed, respectively, and a pair of second conduction paths 923*a* and 923*b* is formed, respectively. First conduction paths 922*a* and 922*b* each have a round shape, and are respectively disposed on the centers of the electric connecting plates. Second conduction paths 923*a* and 923*b* each have an annular-ring shape, and are respectively disposed concentrically about the centers of the electric connecting plates. Moreover, on principal faces on the other sides of electric connecting plates 921*a* and 921*b*, a pair of third conduction paths 924*a* and 924*b* is formed, respectively, and a pair of fourth conduction paths 925*a* and 925*b* is formed, respectively. Third conduction paths 924*a* and 924*b* each have a round shape, and are electrically connected with the pair of conduction paths 922*a* and 922*b*, respectively. Fourth conduction paths 925*a* and 925*b* each have a round shape, and are electrically connected with the pair of second conduction paths 923*a* and 923*b*, respectively.

Third conduction path 924*a* of electric connecting plate 921*a* is coupled with first connection terminal 23*a* of circuit unit 20. In addition, fourth conduction path 925*a* of electric connecting plate 921*a* is coupled with second connection terminal 23*b* of circuit unit 20. For example, first connection terminal 23*a* is a negative pole, while second connection terminal 23*b* is a positive pole.

On the other hand, third conduction path 924*b* of electric connecting plate 921*b* is coupled with first connection terminal 13*a* of light emitting module 10. In addition, fourth conduction path 925*b* of electric connecting plate 921*b* is coupled with second connection terminal 13*b* of light emitting module 10. For example, first connection terminal 13*a* is a negative pole, while second connection terminal 13*b* is a positive pole.

Electric connecting plates 921*a* and 921*b* are disposed to face each other. In the state of radiation member 50 being fitted onto case 30, first conduction path 922*a* is in contact with first conduction path 922*b*, while second conduction path 923*a* is in contact with second conduction path 923*b*.

Even when radiation member 50 is rotated about center axis J relative to case 30, it is possible to retain both the electrical connections, i.e. the connection between first conduction path 922*a* and first conduction path 922*b* and the connection between second conduction path 923*a* and second conduction path 923*b*. That is, this configuration forms the slip-ring mechanism which brings about the electric connection between case 30 fixed to the lighting fixture (not shown)

and radiation member 50 rotatable relative to case 30. That is, a pressure causes first conduction paths 922*a* and 922*b* to be in contact with each other, and second conduction paths 923*a* and 923*b* to be in contact with each other.

In illumination light source 900, because of the adoption of the slip-ring mechanism described above, there is no possibility of disconnection and breakage of the lead wires, even when radiation member 50 is rotated relative to case 30. Accordingly, light emitting module 10 can stably receive power supply from circuit unit 20.

Figure 22:
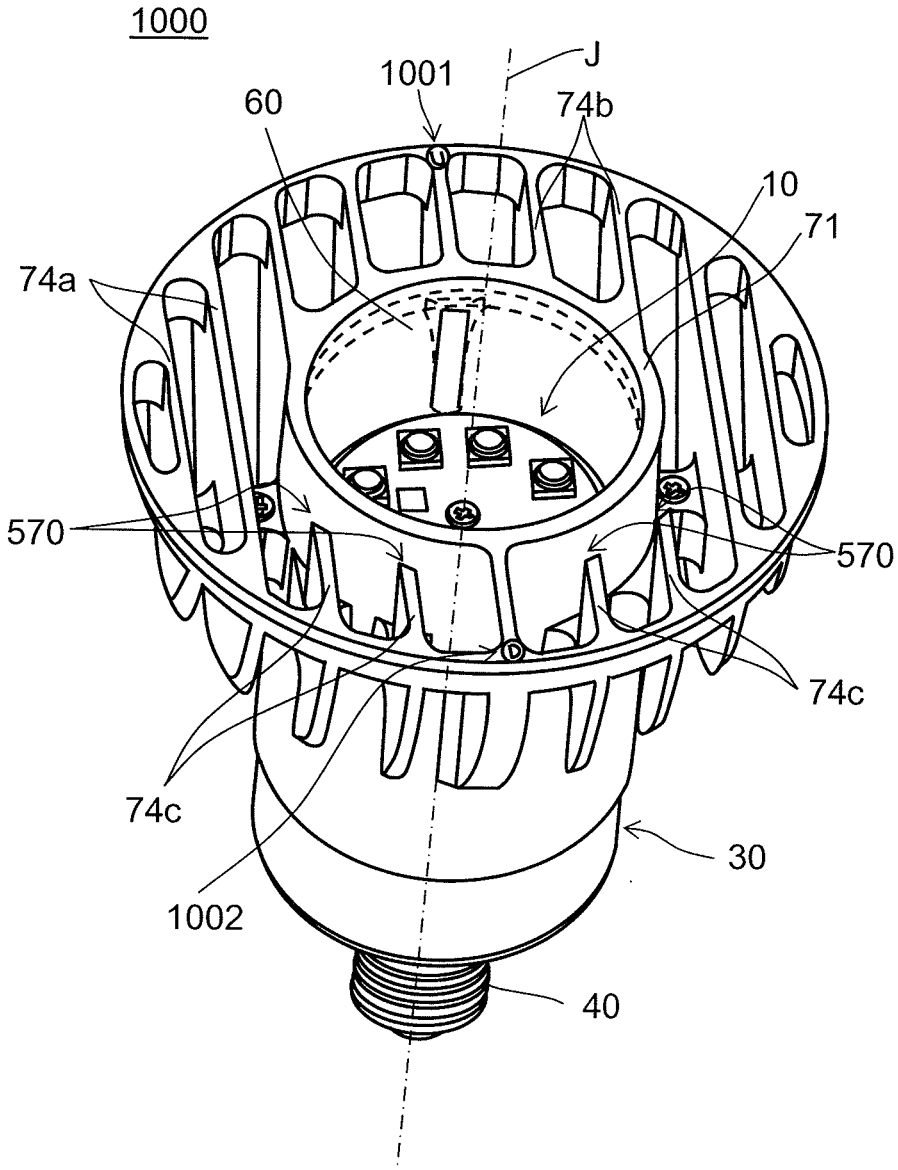
FIG. 22 is a perspective view of an illumination light source of Modified Example 3 according to the embodiment.

A mark to indicate the direction in which the radiation fins are preferably oriented may be disposed in the illumination light source. FIG. 22 is a perspective view of illumination light source 1000 of Modified Example 3. In the case shown in the Figure, marks 1000 and 1002 to indicate the direction in which radiation fins 74 are preferably oriented are disposed in rim part 76. In the Figure, "U" means the vertically upward direction (UP), while "D" means the vertically downward direction (DOWN). Marks 1000 and 1002 let the user know the direction in which radiation fins 74 are preferably oriented.

In illumination light source 500 shown in FIG. 13, the descriptions have been made for the examples where the pass-through parts are disposed in a specific plurality of the fins, among the plurality of the radiation fins. That is, the specific plurality of the fins are ones that are disposed on the outer wall of the tube-like part and that are present in one of the two regions partitioned by boundary plane C. However, the present disclosure is not necessarily limited to the examples. The pass-through parts may be disposed in the radiation fins present on plane A. Moreover, the pass-through parts may be disposed in the radiation fins present in the other of the two regions partitioned by boundary plane C.

In illumination light source 600 shown in FIG. 15, the descriptions have been made for the examples where the location of the center of gravity of the second housing member is adjusted to be out of the center axis, by increasing the thicknesses of the plates of some of the plurality of the radiation fins. However, the present disclosure is not necessarily limited to the examples. For example, the location of the center of gravity of the second housing member may be adjusted to be out of the center axis, in plane A, by changing the weights or the like of the other parts of the second housing member.

In the various embodiments described above, the descriptions have been made for the examples where the bases are Edison-type screw bases. However, the present disclosure is not necessarily limited to the examples. For example, the base may be a bayonet base including GU5.3, G4, P28s, and B22d.

In other Modified Examples concerning the light emitting module, the mounting substrate is not limited to the metal-base substrate, and may be an already-available substrate, such as a resin substrate and a ceramic substrate, other than the metal-base substrate. Moreover, the light source is not limited to the source using LEDs, and may be one which uses semiconductor light-emitting elements other than LEDs, such as LDs (Laser Diodes) or EL-elements (Electroluminescence elements), for example. Furthermore, the light source is not limited to the source that emits white light, and may be one that emits light of any other color. In addition, the LEDs may employ any structure type, including a shell type, an SMD (Surface Mounted Device) type, a COB (Chip On Board) type, and a power LED type.

It should be noted that any combination may be employed among the aforementioned various embodiments and the aforementioned Modified Examples.

What is claimed is:

1. An illumination light source comprising:

a light emitting module;

a circuit unit electrically coupled with the light emitting module;

a base electrically coupled with the circuit unit;

a tube-like first housing member including the light emitting module on one opening side and the base on an other opening side, and accommodating the circuit unit inside the first housing member; and a second housing member including:

a rotary ring body having a rotation axis agreeing with a center axis of the first housing member; and a plurality of plate-like radiation fins disposed in parallel with one virtual plane containing the rotation axis, and disposed at intervals in a direction orthogonal to the virtual plane, wherein an inner wall of the rotary ring body surrounds and fits onto an outer wall of the first housing member.

2. The illumination light source according to claim 1, wherein the second housing member further includes a tube-like part surrounding the rotation axis, the plurality of the radiation fins is disposed on an outer side of the tube-like part, and at least one of the plurality of the radiation fins is disposed at a location outward away from an outer wall of the tube-like part in the orthogonal direction.

3. The illumination light source according to claim 2, wherein at least one of the plurality of the radiation fins is disposed on the outer wall of the tube-like part, and a pass-through part from a first principal face to a second principal face opposite to the first principal face is formed in the at least one of the plurality of the radiation fins disposed on the outer wall of the tube-like part.

4. The illumination light source according to claim 3, wherein, only in one of two regions partitioned by a boundary surface assumed to be a plane which contains the rotation axis and is orthogonal to the virtual plane, the pass-through part is formed in the at least one of the plurality of the radiation fins disposed on the outer wall of the tube-like part.

5. The illumination light source according to claim 4, wherein a center of gravity of the second housing member is present in the one region from the rotation axis, in the virtual plane.

6. The illumination light source according to claim 2, wherein a first light-through hole is formed in the tube-like part between adjacent two of the plurality of the radiation fins, and in a traveling direction of light emitted from the light emitting module; and a second light-through hole is formed in a fin, among the plurality of the radiation fins, located in the orthogonal direction from the rotation axis, and in a traveling direction of light emitted from the light emitting module.

7. The illumination light source according to claim 1, wherein the second housing member accommodates the light emitting module.

8. The illumination light source according to claim 1, wherein a gap between adjacent two of the plurality of the radiation fins becomes smaller, with increasing distance away from the rotation axis along the orthogonal direction.

9. The illumination light source according to claim 1, wherein the base is an Edison-type screw base, and a rotation torque required for rotating the second housing member about the center axis is not smaller than 0.5 Nm and not larger than 5.0 Nm.

10. The illumination light source according to claim 1, wherein the plurality of the radiation fins is disposed on an outer wall of the rotary ring body.

11. The illumination light source according to claim 1, wherein the first housing member includes:

a first case member;

a second case member; and a rotation mechanism between the first case member and the second case member, and wherein the rotary ring body is fitted onto an outer periphery of the second case member.

12. The illumination light source according to claim 1, further comprising:

a first and second connection terminals disposed in each of the circuit unit and the light emitting module;

a pair of first conduction paths to electrically couple the first connection terminal of the circuit unit with the first connection terminal of the light emitting module; and a pair of second conduction paths to electrically couple the second connection terminal of the circuit unit with the second connection terminal of the light emitting module, wherein each path of the pair of the first conduction paths is in contact with each other by a pressing force, and each path of the pair of the second conduction paths is in contact with each other by pressing force.

* * * * *